US011852015B2

(12) United States Patent
Cramer

(10) Patent No.: US 11,852,015 B2
(45) Date of Patent: Dec. 26, 2023

(54) ROTARY STEERABLE DRILLING SYSTEM

(71) Applicant: Sparrow Downhole Tools Ltd., Calgary (CA)

(72) Inventor: David Cramer, Calgary (CA)

(73) Assignee: SPARROW DOWNHOLE TOOLS LTD., Calgary (CA)

( * ) Notice: Subject to any disclaimer, the term of this patent is extended or adjusted under 35 U.S.C. 154(b) by 151 days.

(21) Appl. No.: 17/603,722

(22) PCT Filed: Apr. 15, 2020

(86) PCT No.: PCT/CA2020/050503

§ 371 (c)(1),
(2) Date: Oct. 14, 2021

(87) PCT Pub. No.: WO2020/210905

PCT Pub. Date: Oct. 22, 2020

(65) Prior Publication Data

US 2022/0195803 A1 Jun. 23, 2022

Related U.S. Application Data

(60) Provisional application No. 62/888,197, filed on Aug. 16, 2019, provisional application No. 62/833,792, filed on Apr. 15, 2019.

(51) Int. Cl.
*E21B 7/06* (2006.01)
*E21B 34/06* (2006.01)
(Continued)

(52) U.S. Cl.
CPC ..... *E21B 7/06* (2013.01); *E21B 34/066* (2013.01); *E21B 34/16* (2013.01); *E21B 49/00* (2013.01)

(58) Field of Classification Search
CPC ..... E21B 7/06; E21B 34/066; E21B 34/16; E21B 49/00; E21B 44/00
See application file for complete search history.

(56) References Cited

U.S. PATENT DOCUMENTS 5,520,255 A * 5/1996 Barr ..... E21B 7/06 175/73
5,685,379 A * 11/1997 Barr ..... E21B 7/06 175/73

(Continued)

FOREIGN PATENT DOCUMENTS

| | | |
|---|---|---|
| RU | 2455448 | 7/2012 |
| RU | 2513602 | 4/2014 |
| WO | 2018085042 | 5/2018 |

OTHER PUBLICATIONS

The International Searching Agency, International Search Report dated Jun. 11, 2020, in International Application No. PCT/CA2020/050503, seven pages.

(Continued)

*Primary Examiner* — Steven A MacDonald
(74) *Attorney, Agent, or Firm* — Dickinson Wright PLLC

(57) ABSTRACT

A bias subsystem for a steerable bottom hole assembly (BHA) includes a housing having a rotational axis; a plurality of flow conduits in the housing to convey drilling fluid received at an upstream end of the housing towards a downstream end of the housing; a plurality of hydraulic thrust structures each extending from within the housing to the periphery of the housing; and a plurality of valve conduits in the housing to each convey drilling fluid to a respective one of the hydraulic thrust structures, wherein the flow conduits are not intermediate the hydraulic thrust structures and the rotational axis.

20 Claims, 13 Drawing Sheets

(51) Int. Cl.
*E21B 34/16* (2006.01)
*E21B 49/00* (2006.01)

(56) References Cited

U.S. PATENT DOCUMENTS

| | | | | |
|---|---|---|---|---|
| 6,213,226 | B1 | 4/2001 | Eppink et al. | |
| 6,601,658 | B1 * | 8/2003 | Downton | E21B 47/022 702/9 |
| 6,715,570 | B1 * | 4/2004 | Downton | E21B 7/04 175/312 |
| 8,497,685 | B2 * | 7/2013 | Sugiura | E21B 47/024 324/345 |
| 8,672,056 | B2 * | 3/2014 | Clark | E21B 17/1014 175/45 |
| 8,869,916 | B2 * | 10/2014 | Clausen | E21B 7/06 175/73 |
| 9,016,400 | B2 * | 4/2015 | Clausen | E21B 17/1014 175/73 |
| 9,624,727 | B1 * | 4/2017 | Hutton | E21B 7/06 |
| 10,633,925 | B2 * | 4/2020 | Panda | B23H 9/00 |
| 11,236,583 | B2 * | 2/2022 | Chambers | E21B 7/06 |
| 11,332,979 | B2 * | 5/2022 | Deolalikar | E21B 7/06 |
| 11,421,481 | B2 * | 8/2022 | Chambers | E21B 7/068 |
| 2002/0179336 | A1 | 12/2002 | Schaaf et al. | |
| 2003/0079913 | A1 | 5/2003 | Eppink et al. | |
| 2005/0006145 | A1 * | 1/2005 | Downton | E21B 47/022 175/45 |
| 2006/0249287 | A1 * | 11/2006 | Downton | E21B 7/06 166/250.1 |
| 2008/0053707 | A1 * | 3/2008 | Martinez | G01V 11/005 175/73 |
| 2012/0160563 | A1 * | 6/2012 | Clark | E21B 7/062 175/73 |
| 2012/0160564 | A1 | 6/2012 | Downton et al. | |
| 2012/0160565 | A1 | 6/2012 | Downton et al. | |
| 2014/0014413 | A1 * | 1/2014 | Niina | E21B 21/10 175/76 |
| 2015/0107902 | A1 | 4/2015 | Downton | |
| 2015/0337598 | A1 | 11/2015 | Rushton et al. | |
| 2016/0069139 | A1 | 3/2016 | Sugiura et al. | |
| 2016/0084007 | A1 * | 3/2016 | Sugiura | E21B 17/1092 175/76 |
| 2018/0016844 | A1 * | 1/2018 | Peters | E21B 17/1078 |
| 2018/0128060 | A1 * | 5/2018 | Haugvaldstad | E21B 7/06 |

OTHER PUBLICATIONS

Russian Office Action and Search Report dated Aug. 17, 2023 (Aug. 17, 2023), 17 pages, including English translations, issued on related Russian patent application 2021132881/03, by the Federal Institute of Industrial Property (FIIP), Moscow.

* cited by examiner

ROTARY STEERABLE DRILLING SYSTEM

CROSS REFERENCE TO RELATED APPLICATION

This application claims priority to U.S. Provisional Patent Application Ser. No. 62/833,792 filed on Apr. 15, 2019 and to U.S. Provisional Patent Application Ser. No. 62/888,197 filed on Aug. 16, 2019. The contents of each of these priority applications is incorporated herein by reference entirely.

FIELD OF THE INVENTION

The following relates generally to drilling technology, and more particularly to rotary steerable drilling systems.

BACKGROUND OF THE INVENTION

It can be desirable, when drilling or coring holes in a subsurface formation with a drilling rig having a drill string, to be able to modify the direction of drilling so that the borehole can be oriented in a particular desired direction thereby to eventually reach a target. Various arrangements are known for provided steering capabilities as part of a bottom hole assembly (BHA) in a drill string.

For example, European Patent No. EP0728909 to Barr et al. is directed to a steerable rotary drilling system, U.S. Pat. No. 5,685,379 to Barr et al. is directed to a method of operating a steerable rotary drilling system, and U.S. Pat. No. 10,544,650 to Farley et al. is directed to a rotating disk valve for a rotary steerable tool.

While various arrangements are known, improvements are desirable. For example, it can be desirable to provide systems and to execute methods that are more efficient, cost-effective and controllable.

SUMMARY OF THE INVENTION

In accordance with an aspect, there is provided a steerable bottom hole assembly (BHA) comprising: a drill string component incorporating an actuator subsystem, the actuator subsystem comprising an actuator having an output shaft for selectively rotating a valve plate about a rotational axis of the BHA; the actuator subsystem further comprising: a position marker on the output shaft; a position sensor proximate the output shaft, wherein the position sensor and the position marker interact when the position marker is rotated with the output shaft to a position adjacent the position sensor, the position sensor in response signalling the actuator subsystem for use in controlling the rotational orientation of the valve plate; the BHA assembly further comprising a bias subsystem extending between the drill string component and a drill bit, the bias subsystem receiving a flow of pressurized drilling fluid via the drill string component and comprising: a housing; a plurality of hydraulic thrust structures associated with a periphery of the housing; a plurality of central valve conduits in the housing to convey drilling fluid for actuating a respective one of the hydraulic thrust structures; and a plurality of peripheral flow conduits in the housing to convey drilling fluid towards the drill bit, the flow conduits being closer to the periphery than the central valve conduits, wherein, in accordance with a selected rotational orientation of the valve plate with respect to the valve conduits, pressurized drilling fluid is selectively permitted, or blocked from, entry into the valve conduits.

In an embodiment, the bias subsystem further comprises: a flow-converger downstream of the thrust structures, the flow-converger incorporating converger conduits for receiving and converging flows of drilling fluid from the central valve conduits and the peripheral flow conduits into a single output flow prior to entry into the drill bit.

In an embodiment, the steerable BHA further comprises within the housing: a fluid manifold having an upstream face with: a peripheral region incorporating flow ports each associated with a respective one of the peripheral flow conduits; and a central region incorporating valve ports each associated with a respective one of the central valve conduits, the central region interfacing with the plate for, in accordance with a selected rotational orientation of the plate with respect to the upstream face, blocking or sequentially permitting drilling fluid to enter into the valve ports.

In an embodiment, the fluid manifold is affixed within housing.

In an embodiment, the fluid manifold incorporates: two flow ports; and two valve ports.

In an embodiment, each of the two peripheral flow conduits extends downstream substantially in parallel with a rotational axis of the bias subsystem.

In an embodiment, each of the two central valve conduits extends downstream substantially in parallel with the rotational axis of the bias subsystem.

In an embodiment, each thrust structure comprises: an input port; at least one cylinder in fluid communication with the input port; a piston moveable within each of the at least one cylinder inwards and outwards with respect to a rotational axis of the bias subsystem; a thrust paddle interfacing with the or each piston at the periphery of the housing, the thrust paddle hinged with respect to the housing and pivotable outwards with respect to the rotational axis upon outwards movement of the or each piston under hydraulic pressure thereby to extend from the housing.

In an embodiment, each thrust structure comprises two cylinders and two respective pistons.

In an embodiment, the actuator subsystem is fixed and centrally positioned within a fluid conduit of the drilling component thereby to rotate with the drilling component about a rotational axis of the drilling component.

In an embodiment, the actuator subsystem comprises: a tube dimensioned and centrally positioned within the fluid conduit thereby to leave an annular flow region for drilling fluid between the tube and an inner wall of the fluid conduit, wherein the actuator is housed within the tube; and an output shaft associated with the actuator and extending axially beyond a downstream end of the tube thereby to interface with a plate valve component, wherein the valve plate is a part of the plate valve component.

In an embodiment, the plate valve component further comprises a sleeve for receiving the output shaft.

In an embodiment, the output shaft is keyed to be affixed within a corresponding slot within the sleeve of the plate valve component thereby to be rotationally affixed to the sleeve but axially slidable with respect to the sleeve.

In an embodiment, the actuator comprises an electric motor and a gearbox.

In an embodiment, the gearbox provides a reduction ratio of 5.8:1 for the electric motor.

In an embodiment, the steerable BHO further comprises an axial bearing stack within the tube for receiving the output shaft therethrough thereby to axially support the output shaft along the rotational axis of the drilling component.

In an embodiment, the steerable BHA further comprises a radial bearing stack within the tube for receiving the output shaft therethrough thereby to radially support the output shaft along the rotational axis of the drilling component.

In an embodiment, the actuator subsystem further comprises: a control board within the tube and in communication with the actuator thereby to control the rotational angle of the output shaft; a portable power supply for powering at least the control board and the actuator; and a sensor package for measuring the orientation of the earth's magnetic field and a gravity vector.

In an embodiment, the position sensor is a Hall sensor and the position marker is a magnet.

In an embodiment, the valve plate is generally circular and incorporates a notch for allowing passage of drilling fluid downstream of the valve plate into a selected one of the central valve conduits.

In an embodiment, the notch extends inwardly from the periphery of the valve plate towards its centre.

In an embodiment, the notch is dimensioned with respect to the plurality of central valve conduits and the valve plate to be selectively oriented to permit drilling fluid to enter into only one central valve conduit at a time.

In an embodiment, the notch is dimensioned with respect to the plurality of central valve conduits and the valve plate to be selectively oriented to permit drilling fluid to enter into none of the central valve conduits.

In an embodiment, the steerable BHA further comprises a cylindrical pin extending from a downstream face of the valve plate.

In an embodiment, an inward-facing side of each thrust paddle is shaped to symmetrically distribute force imparted on respective one or more pistons across the pistons' stroke axis, through the extent of piston stroke.

In an embodiment, the inward-facing side of each thrust paddle is concave.

In an embodiment, the inward-facing side of each thrust paddle is shaped to, while BHA 50 is centred within a hole, impart force to respective one or more pistons in alignment with a respective stroke axis of the pistons.

In accordance with another aspect, there is provided a bias subsystem for a steerable bottom hole assembly (BHA) comprising: a housing having a rotational axis; a plurality of flow conduits in the housing to convey drilling fluid received at an upstream end of the housing towards a downstream end of the housing; a plurality of hydraulic thrust structures each extending from within the housing to the periphery of the housing; a plurality of valve conduits in the housing to each convey drilling fluid to a respective one of the hydraulic thrust structures, wherein the flow conduits are not intermediate the hydraulic thrust structures and the rotational axis.

In an embodiment, the bias subsystem further comprises: a flow-converger downstream of the thrust structures, the flow-converger incorporating converger conduits for receiving and converging flows of drilling fluid from the valve conduits and the flow conduits into a single output flow prior to exit from the bias subsystem.

In an embodiment, the bias subsystem further comprises within the housing: a fluid manifold having an upstream face with: a peripheral region incorporating flow ports each associated with a respective one of the flow conduits; and a central region incorporating valve ports each associated with a respective one of the valve conduits, the central region dimensioned to interface with an actuator assembly to block or sequentially permit drilling fluid to enter into the valve ports.

In an embodiment, the fluid manifold is affixed within housing.

In an embodiment, the fluid manifold incorporates: two flow ports; and two valve ports.

In an embodiment, each of the two flow conduits extends downstream substantially in parallel with a rotational axis of the housing.

In an embodiment, each of the two valve conduits extends downstream substantially in parallel with the rotational axis of the housing.

In an embodiment, each thrust structure comprises: an input port; at least one cylinder in fluid communication with the input port; a piston moveable within each of the at least one cylinder inwards and outwards with respect to a rotational axis of the bias subsystem; a thrust paddle interfacing with the or each piston at the periphery of the housing, the thrust paddle hinged with respect to the housing and pivotable outwards with respect to the rotational axis upon outwards movement of the or each piston under hydraulic pressure thereby to extend from the housing.

In an embodiment, each thrust structure comprises two cylinders and two respective pistons.

In an embodiment, an inward-facing side of each thrust paddle is shaped to symmetrically distribute force imparted on respective one or more pistons across the pistons' stroke axis, through the extent of piston stroke.

In an embodiment, the inward-facing side of each thrust paddle is concave.

In an embodiment, the inward-facing side of each thrust paddle is shaped to, while BHA 50 is centred within a hole, impart force to respective one or more pistons in alignment with a respective stroke axis of the pistons.

In accordance with another aspect, there is provided an actuator subsystem for a bottom hole assembly (BHA), the actuator subsystem comprising: an actuator insertable within a drilling component and having an output shaft for selectively rotating a valve plate about a rotational axis of the BHA; a position marker on the output shaft; a position sensor proximate the output shaft, wherein the position sensor and the position marker interact when the position marker is rotated with the output shaft to a position adjacent the position sensor, the position sensor in response signalling the actuator subsystem for use in controlling the rotational orientation of the valve plate.

In an embodiment, the actuator subsystem is dimensioned to be fixed and centrally positioned within a fluid conduit of the drilling component thereby to rotate with the drilling component about a rotational axis of the drilling component.

In an embodiment, the actuator subsystem comprises: a tube dimensioned and centrally positioned within the fluid conduit thereby to leave an annular flow region for drilling fluid between the tube and an inner wall of the fluid conduit, wherein the actuator is housed within the tube; and an output shaft associated with the actuator and extending axially beyond a downstream end of the tube thereby to interface with a plate valve component, wherein the valve plate is a part of the plate valve component.

In an embodiment, the plate valve component further comprises a sleeve for receiving the output shaft.

In an embodiment, the output shaft is keyed to be affixed within a corresponding slot within the sleeve of the plate valve component thereby to be rotationally affixed to the sleeve but axially slidable with respect to the sleeve.

In an embodiment, the actuator comprises an electric motor and a gearbox.

In an embodiment, the gearbox provides a reduction ratio of 5.8:1 for the electric motor.

In an embodiment, the actuator subsystem further comprises an axial bearing stack within the tube for receiving the output shaft therethrough thereby to axially support the output shaft along the rotational axis of the drilling component.

In an embodiment, the actuator subsystem further comprises a radial bearing stack within the tube for receiving the output shaft therethrough thereby to radially support the output shaft along the rotational axis of the drilling component.

In an embodiment, the actuator subsystem further comprises: a control board within the tube and in communication with the actuator thereby to control the rotational angle of the output shaft; a portable power supply for powering at least the control board and the actuator; and a sensor package for measuring the orientation of the earth's magnetic field and a gravity vector.

In an embodiment, the position sensor is a Hall sensor and the position marker is a magnet.

In an embodiment, the valve plate is generally circular and incorporates a notch for allowing passage of drilling fluid downstream of the valve plate into a selected one of a plurality of valve conduits in a downstream bias subsystem with which the actuator subsystem can interface.

In an embodiment, the notch extends inwardly from the periphery of the valve plate towards its centre.

In an embodiment, the notch is dimensioned with respect to the plurality of valve conduits in the downstream bias subsystem and the valve plate to be selectively oriented to permit drilling fluid to enter into only one valve conduit of the downstream bias subsystem at a time.

In an embodiment, the notch is dimensioned with respect to the plurality of valve conduits in the downstream bias subsystem and the valve plate to be selectively oriented to permit drilling fluid to enter into none of the central valve conduits of the downstream bias subsystem.

In an embodiment, the actuator subsystem further comprises a cylindrical pin extending from a downstream face of the valve plate.

Other aspects and embodiments will become apparent upon reading the following description.

BRIEF DESCRIPTION OF THE DRAWINGS

Embodiments of the invention will now be described with reference to the appended drawings in which.

DETAILED DESCRIPTION

Figure 1:
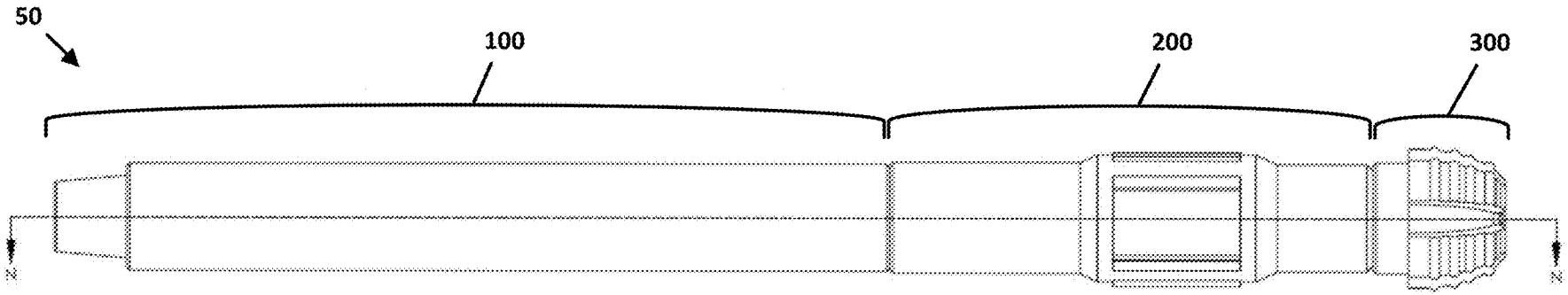
FIG. 1 is an elevation view of a bottom hole assembly, according to an embodiment, including a drill collar, a bias subsystem, and a drill bit.

FIG. 1 is an elevation view of a bottom hole assembly (BHA) 50 for a rotary steerable drilling system, according to an embodiment. In this embodiment, BHA 50 includes a drill collar 100, a bias subsystem 200, and a drill bit 300, connected in series from an upstream end to a downstream end of BHA 50 (left to right in FIG. 1). Drill collar 100, in turn, can be connected at its upstream end to an upstream component (not shown) of a drill string thereby to connect BHA 50 to the rest of the drilling system.

During operation of the drilling system, BHA 50 is rotated generally about a central longitudinal axis within the hole being drilled along with the rest of the drill string to which it is connected. Furthermore, BHA 50 receives at its upstream end a flow of pressurized drilling fluid, or mud, being pumped through the drill string. As will be described, BHA 50 conveys this flow of drilling fluid downstream to exit BHA 50 via drill bit 300. This drilling fluid enters into the hole under pressure to help carry cuttings out of the hole.

In this embodiment, as will be described, bias subsystem 200 can be controlled to selectively direct some of the flow of the pressurized drilling fluid with bias subsystem 200 for steering. Such directed flow is usable for actuating multiple thrust structures that are positioned about the periphery of bias subsystem 200. Actuation of a thrust structure at a particular rotational angle of the drill string causes the thrust structure to push outwards and against the wall of the hole at that rotational angle, thereby to steer BHA 50 in the opposite direction.

Figure 2:
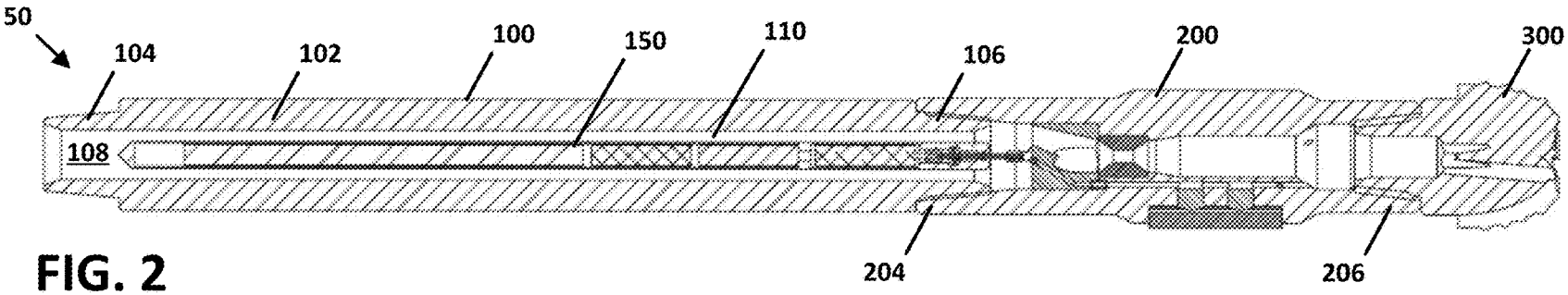
FIG. 2 is a sectional view of the bottom hole assembly of FIG. 1, taken along line N-N in FIG. 1, showing an actuator subsystem housed within the drill collar, according to an embodiment.

FIG. 2 is a sectional view of BHA 50, taken along line N-N in FIG. 1. As shown, drill collar 100 includes a housing 102 having a first threaded section 104 at its upstream end. First threaded section 104 is dimensioned (i.e., sized and shaped) for threading drill collar 100 to an upstream component of the drill string (not shown). Housing 102 also has a second threaded section 106 at its downstream end. Second threaded section 106 is dimensioned for threading drill collar 100 to a first threaded section 204 of bias subsystem 200.

A fluid conduit 108 extends centrally through housing 102 of drill collar 100 from its upstream end through to its downstream end. Fluid conduit 108 conveys drilling fluid towards bias subsystem 200 and drill bit 300. In this embodiment, an actuator subsystem 150 is fixedly positioned within the center of fluid conduit 108 thereby to rotate along with drill collar 100 about its central axis during operation of the drill string. Actuator subsystem 150 extends partly beyond the downstream end of drill collar 100 to interface with components of bias subsystem 200 and to, in doing so, control steering as will be described.

Actuator subsystem 150 is dimensioned, and is positioned within fluid conduit 108, to leave a substantial annular flow region 110 between its periphery and the inner wall of fluid conduit 108. Annular flow region 110 permits drilling fluid to continue to be conveyed from the upstream end of drill collar 100 through to and out of its downstream end.

Figure 3:
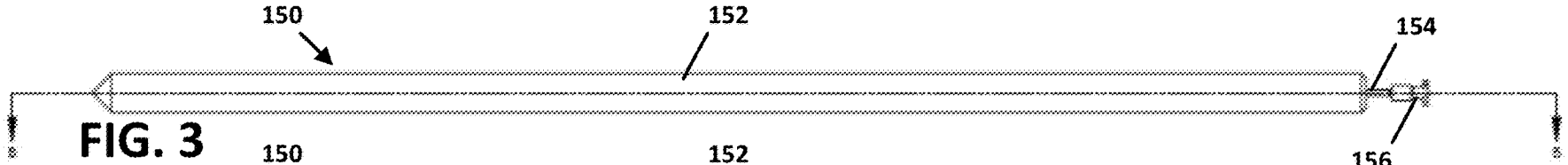
FIG. 3 is a magnified elevation view of the actuator subsystem of FIG. 2 in isolation.
Figure 4:
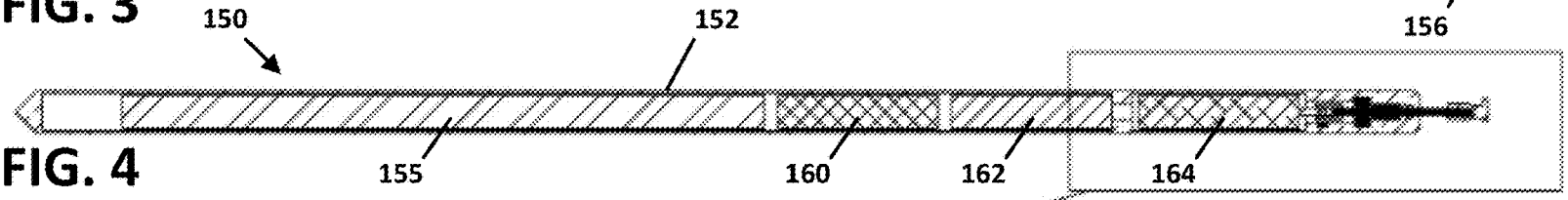
FIG. 4 is a sectional view of the actuator subsystem of FIG. 3, taken along line B-B in FIG. 3.

FIG. 3 is a magnified elevation view of actuator subsystem 150 in isolation, and FIG. 4 is a sectional view of actuator subsystem 150, taken along line B-B in FIG. 3. In this embodiment, actuator subsystem 150 operates as a rotary valve system. In, addition, actuator subsystem 150 is "probe" based. For example, its components (portable power supply such as batteries, actuator, control board, sensors as will be described) are housed in a probe-like tube 152 with standard Measurement While Drilling (MWD) dimensions. In this embodiment, tube 152 is cylindrical and has an outer diameter of 1⅞ (one and seven-eighths) inches. Extending from the downstream end of tube 152 is a rotatable output shaft 154, which is keyed to be affixed within a corresponding slot within a sleeve of a plate valve component 156. Plate valve component 156 is thereby caused to rotate when output shaft 154 rotates, without slipping. However, output shaft 154 and plate valve component 156 are axially decoupled to permit a small amount of axial sliding with respect to each other. This axial "play" is only slight. The axial play is useful for accommodating for a potential stack up of tolerances either in the "too short" direction or the "too long" direction. It is useful to have plate valve component 156 sit on upstream face 222 without necessarily being driven into it, as might otherwise happen were the stack up of tolerances during machining of components to cause the sequence of components to extend slightly too far, or slightly not far enough, than might be useful for reliable long term functioning. That is, it is preferable from both wear and power consumption standpoints, that plate valve component 156 can be rotated with respect to upstream face 222 under the influence of output shaft 154 with as little friction between upstream face 222 and plate valve component 156 as possible, while also working to effectively block and unblock valve ports as described.

As will be described, output shaft 154 is rotatable with respect to tube 152 by an actuator 164 (in this embodiment, an electric motor/gearbox package) within tube 152. This, in turn rotates plate valve component 156 with respect to tube 152. In this way, plate valve component 156 is rotatable with respect to components of bias subsystem 200 with which plate valve component 156 is to interface.

As shown in FIG. 4, a portable power supply, in this embodiment a battery pack array 155, provides electrical power to electric motor/gearbox 164 as well as to sensor package 160 and control board 162. In this embodiment, battery pack array 155 has a single battery pack including eight (8) DD lithium primary cells wired in series. As each cell has a voltage of 3.6V, the nominal voltage of the pack is 28.8V. In embodiments, battery pack array 155 includes two battery packs, to provide approximately 100 hours of constant operation downhole. Battery pack array 155 could have more battery packs as desired as could be accommodated within the physical dimensions of actuator subsystem 150.

Sensor package 160 includes, in this embodiment, three (3) orthogonal magnetometers for measuring the orientation of the earth's magnetic field with respect to the sensor package 160 and three (3) orthogonal accelerometers for measuring gravity vector with respect to the sensor package 160. Control board 162 supports and provides power to a processing structure, such as a microprocessor, for receiving data signals from these sensor package components. The processing structure processes the data signals and conducts predictive filtering to smooth incoming signals. The processing structure is also configured to accommodate for latency incurred in the capture of signals and in the processing time taken while the tool is rotating at several hundred RPM (revolutions per minute). Generally, the processing structure is configured to derive a roll angle vector representing a direction from the measured orientation of the BHA 50 towards a target orientation of the BHA 50. With the roll angle vector having been determined, the control board 162 can activate electric motor/gearbox 164 accordingly to rotate plate valve component 156. Rotation of plate valve component 156 is controlled so that its rotational speed puts it at a position with respect to bias subsystem 200 that corresponds to the target roll angle minus the measured roll angle. As would be understood, processing structure on control board 162 is configured to account for a time lag between capture of measurements at sensor package 160 and responsive actuation of electric motor/gearbox 164.

Figure 5:
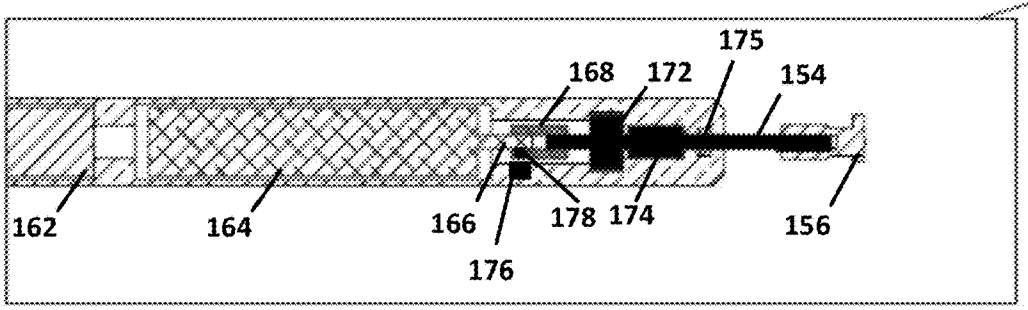
FIG. 5 is a magnified view of a downstream portion of the actuator subsystem shown in FIG. 4.

FIG. 5 is a magnified view of a downstream portion of actuator subsystem 150. In this embodiment, electric motor/gearbox 164 is a single package that includes an electric motor with the gearbox providing a reduction ratio of 5.8:1. The output shaft 166 of motor/gearbox 164 is coupled with a coupler 168 to output shaft 154. Output shaft 154 extends from coupler 168 all the way to plate valve component 156. In this embodiment, output shaft 154 extends through both axial load thrust bearing stack 172 for resisting axial movement of output shaft 154 and radial bearing stack 174 for resisting radial movement of output shaft 154. A seal 175 is positioned at the downstream end of tube 152 for inhibiting ingress of drilling fluid or other material.

A position sensor 176 is affixed within tube 152 proximate coupler 168, and a corresponding position indicator 178 is affixed at a point along coupler 168 corresponding to the axial location of position sensor 176. Position sensor 176 and position indicator 178 interact to enable position sensor 176 to know when position indicator 178 has rotated to a position proximate to position sensor 176 so position indicator 178 can signal control board 162 each time position indicator 178 is proximate to position sensor 176. In this embodiment, position sensor 176 is a Hall sensor, and position indicator 178 is a magnet. When output shaft 154 is rotated such that position indicator 178 is rotated to be adjacent to position sensor 176, position sensor 176 rapidly electrically signals control board 162. Control board 162 is thereby made aware of the rotational position and speed of output shaft 154 with respect to drill collar 100 as output shaft 154 rotates. Control board 162 therefore, in turn, can be aware of the rotational position of plate valve component 156 with respect to bias subsystem 200. By having information about the rotational position of plate valve component 156 with respect to bias subsystem 200, control board 162 adapt or maintain the rotational position. This is done by control board 162 instructing electric motor/gearbox 164 to speed, slow or stop rotation of output shaft 166 thereby to affect steering of BHA 50.

In this embodiment, position sensor 176 includes circuitry for filtering (such as Kalman filtering) in order to produce reliable shaft position data even under downhole conditions of vibration.

In an embodiment, control board 162 is configured to be selectively operated using a duty cycle thereby to effect a push rate of the bias subsystem 200. For example, a duty cycle could be established that would cause the bias subsystem 200 to provide steering bias for one minute, and then no steering bias for one minute, and then steering bias for one minute. More particularly, a 50% duty cycle. Control board 162 could be configured to operate bias subsystem 200 according to various other duty cycles.

In an embodiment, control board 162 can receive and act on commands from the surface of the borehole to change operation of BHA 50. As it can be impractical to use wired connections from surface through to BHA 50, another means of communication can be employed. For example, drilling fluid pumps could be controlled to modulate the flow of drilling fluid, or the rotational speed of the drill string could be modulated, thereby to provide signalling downhole. Actuator subsystem 150 could be provisioned with components for detecting changes in vibration levels or rotational speeds thereby to detect the signalling and respond accordingly with control signals for the electric motor 164. The data rates for such modes of downhole communication are typically less than 0.3 bits per second. Other techniques for sending signals downhole may be employed.

In an embodiment, signals may be transmitted from actuator subsystem 150 to the surface during operation, using a mud pulser component or using EM telemetry (whereby electrical signals are transmitted via the medium of the rock formation itself). Such a system could employ a mud pulse or EM transmitter directly on the BHA 50. Alternatively, a short hop communication system could be employed.

Figure 7:
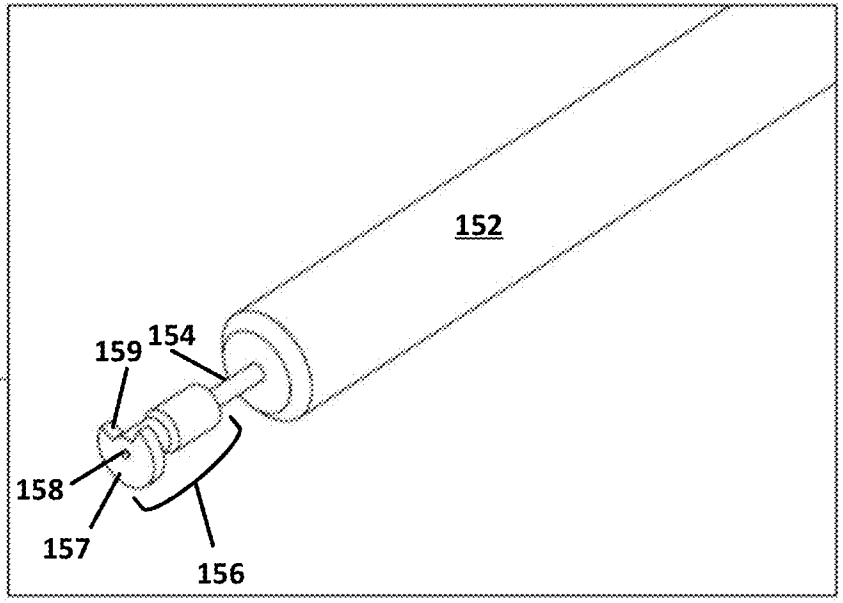
FIG. 7 is a magnified isometric view of a downstream portion of the actuator subsystem shown in FIG. 6.
Figure 6:
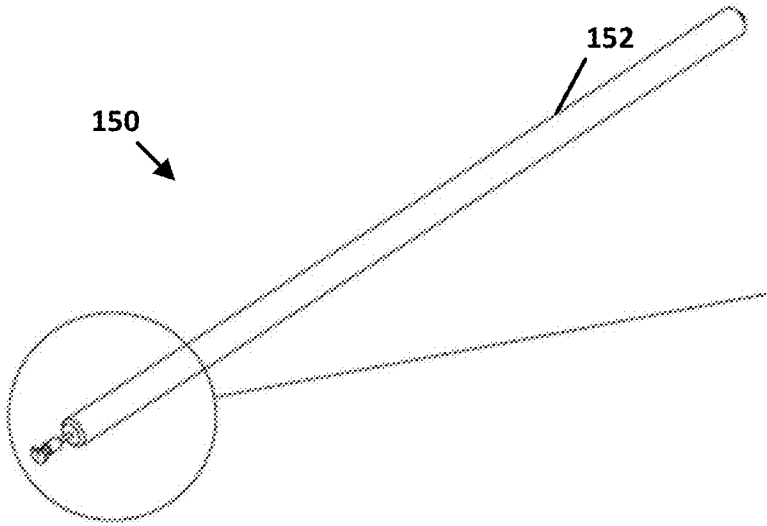
FIG. 6 is an isometric view of the actuator subsystem shown in FIG. 3.

FIG. 6 is an isometric view of actuator subsystem 150, and FIG. 7 is a magnified isometric view of a downstream portion of actuator subsystem 150. As shown in FIG. 7, plate valve component 156 includes a plate 157. Plate 157, in this embodiment, is generally circular and incorporates a notch 159 extending inwards from one portion of its periphery partway towards its center. Notch 159, in this embodiment, is dimensioned (i.e., has an arc angle and inward extent) to enable notch 159 to align with only one underlying valve port at a time. That is, to unblock only one valve port while blocking the other valve port(s). This permits drilling fluid to pass downstream through notch 159 and into only the valve port that is aligned with notch 159. At such an orientation of plate 157, the remainder of plate 157 substantially blocks any other underlying valve ports from receiving drilling fluid.

Furthermore, in this embodiment, notch 159 is dimensioned to enable notch 159 to selectively be aligned with none of the underlying valve ports. That is, to be oriented so that the remainder of plate 157 blocks all valve ports. In this way, drilling fluid can be kept from entering into any of the thrust structures by controlling the orientation of plate 157 and, in particular, notch 159. This "neutral" position may be useful for when steering is not required (known colloquially as "coast-mode"). It may be noted that a kind of coast-mode may be achieved in a different way by continuing to actuate all of the thrust structures in a quasi-random or some other self-opposing way while the drill string is turning, thereby causing no effective steering. However, continuing to actuate thrust structures in this way even when steering is not required continues to use energy and to impart wear and tear to the thrust structures and other components; the thrust paddles are still being forced against the wall of the hole. However, by providing a valve structure as described herein that is configured so that it can be oriented to unblock only one valve port at a time and, additionally, can alternatively be oriented to block all valve ports for a time so that none of the thrust structures are actuated, wear and tear on at least the thrust structure components, as well as power consumption, may be reduced as compared with other approaches to achieving coast-mode.

It will be understood that the angle/size of notch 159 within plate 157 can be selected depending on the number of valve ports, their sizes, and the distances in between the valve ports.

The notch extending inwards in plate 157 from the periphery, in contrast to (for example) an aperture (such as a circular hole) through plate 157 that is spaced from the periphery, enables plate 157 to have a circumference that extends only as far as the valve ports extend from the center of upstream face 222. It will be understood that little interference with the flow ports by plate 157 is desirable, so that the flow ports are as unimpeded as possible by plate 157. While an alternative plate having a hole therethrough that is spaced inwards from its periphery for aligning with an underlying valve port may be functional, such an alternative plate would have a radius that is larger than the distance a valve port extends from the center of upstream face 222. That is, such an alternative plate, to accommodate the full hole through it that aligns with an underlying valve port, would have a radius that is larger than is necessary for just covering the valve ports. Because such an alternative plate would have a larger radius than necessary, flow ports might have to be spaced farther from the rotational axis of bias subsystem 200 so that they could not be even partially blocked by the alternative plate. So, by providing notch 159 extending inward from the periphery of plate 157 as described herein, a large enough opening can be provided for allowing drilling fluid to pass into selected valve ports, without requiring the radius of plate 157, nor the distance of flow ports from the rotational axis of subsystem 200, to be larger than necessary.

In this embodiment, extending from the center of the downstream face of plate 157 is a short cylindrical pin 158 that will contact a corresponding component of bias subsystem 200 thereby to enable plate valve component 156 to rotate with respect to bias subsystem 200 with very little added friction. This permits plate valve component 156 to be reliably rotated by battery-powered electric motor 164 with little power draw.

Figure 8:
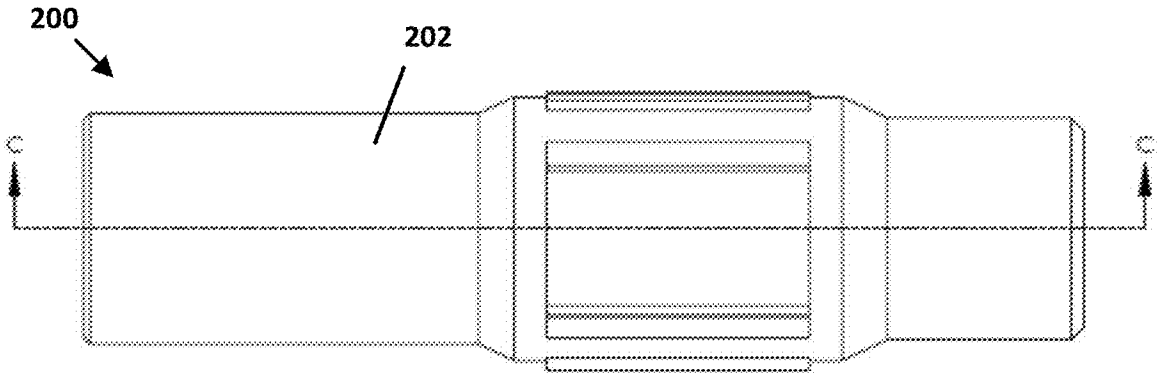
FIG. 8 is an elevation view of the bias subsystem of FIG. 1, in isolation.
Figure 9:
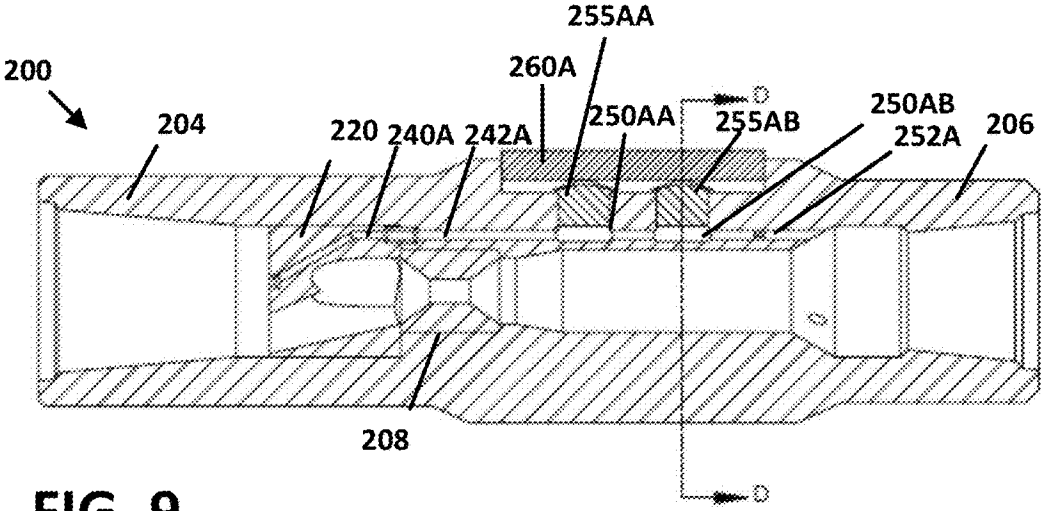
FIG. 9 is a sectional view of the bias subsystem of FIG. 8, taken along line C-C in FIG. 8.

FIG. 8 is an elevation view of bias subsystem 200, in isolation, and FIG. 9 is a sectional view of bias subsystem 200, taken along line C-C in FIG. 8. In this embodiment, bias subsystem 200 includes a housing 202 incorporating a fluid manifold 220 just downstream of first threaded section 204. Fluid manifold 220 has an upstream face 222 that faces a flow of drilling fluid exiting from drill collar 100.

Figure 13:
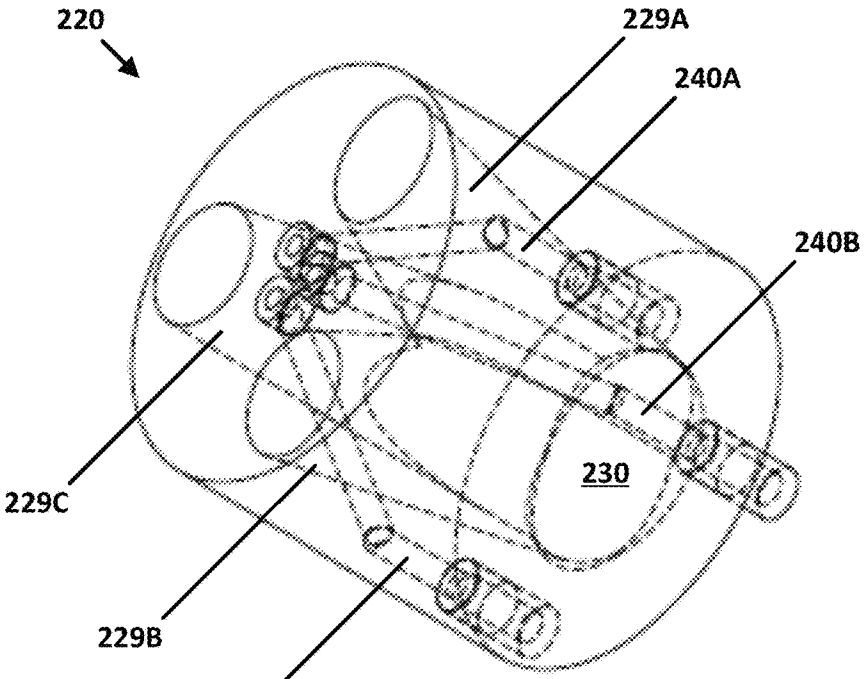
FIG. 13 is an isometric view of the fluid manifold of FIG. 12, with internal fluid conduits shown in dashed lines.
Figure 12:
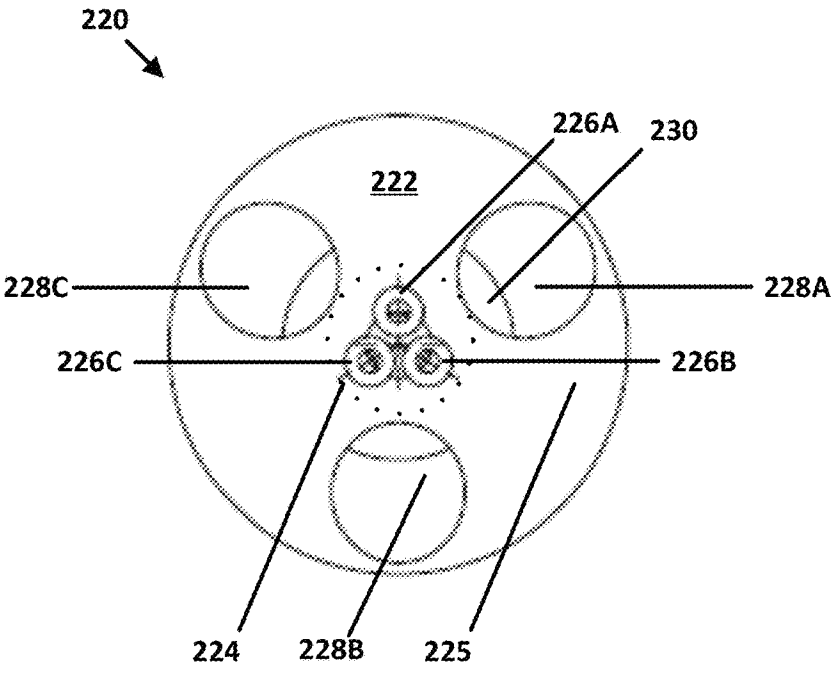
FIG. 12 is an upstream end view of a fluid manifold of the bias subsystem of FIG. 8, according to an embodiment.

FIG. 12 is an upstream end view of fluid manifold 220, according to an embodiment, and FIG. 13 is an isometric view of the fluid manifold of FIG. 12, with internal fluid conduits shown in dashed lines.

Upstream face 222 has a central region 224 (shown in dotted lines in FIG. 12) and a peripheral region 225 extending from the central region to the periphery of upstream face 222. In this embodiment, within central region 224 are three (3) valve ports 226A, 226B and 226C. Valve ports 226A, 226B and 226C are flush with and open to upstream face 222. Each of valve ports 226A, 226B and 226C is in fluid communication with a respective valve conduit 240A, 240B and 240C extending downstream from upstream face 222 of fluid manifold 220.

As will be described below, when drill collar 100 is threaded to bias subsystem 200, plate 157 extending from actuator subsystem 150 extends towards and eventually into contact with upstream face 222. Plate 157 is therefore aligned centrally with respect to central region 224 of upstream face 222 and valve ports 226A, 226B and 226C. Cylindrical pin 158 extending from the downstream face of plate 157 contacts a portion of central region 224 of upstream face 222 between valve portions 226A, 226B and 226C. In embodiments, a short cylindrical cup (not shown) having walls that are parallel to the rotational axis of BHA 50 extends just slightly downstream from upstream face 222. This is provided for receiving the short cylindrical pin 158 thereby to help maintain plate 157 in a central position facing central region 224. In such embodiments, the short cylindrical cup is preferably sized to interfere very little with the rotation of short cylindrical pin 158. For example, it is preferably just slightly shallower than the corresponding extent of pin 158 so that the downstream face of plate 157 is not actually contacting upstream face 222 as it rotates with respect to it, but rather is very slightly spaced from it, thereby to keep friction low as between the two components. In this embodiment, pin 158 has a diameter of between 1/16 and 1/8 inch with a length of about 1/32 inch, and the short cylindrical cup in turn has a diameter about $10/1{,}000^{th}$'s of an inch larger than pin 158 with a depth of about $10/1{,}000^{th}$'s of an inch shorter than the length of pin 158. Alternatives are possible.

By controlling the rotational position of plate 157 with respect to central region 224, plate 157 blocks or unblocks valve ports 226A, 226B or 226C. This, in turn, provides actuator subsystem 150 with control over whether pressurized drilling fluid received within drill collar 100 can enter into any of valve ports 226A, 226B or 226C.

Within peripheral region 225 of upstream face 222 are three (3) flow ports 228A, 228B and 228C. Flow ports 228A, 228B and 228C are flush with and open to upstream face 222. In this embodiment, each of flow ports 228A, 228B and 228C is in fluid communication with a respective flow conduit 229A, 229B and 229C extending downstream from upstream face 222 of fluid manifold 220. Plate 157 is sized only to interface with central region 224 of upstream face 222 and not substantially with peripheral region 225 of upstream face 222. As such, flow ports 228A, 228B and 228C remain substantially unblocked by any valve structure. Because of this, a main flow of drilling fluid can proceed downstream to be conveyed towards drill bit 300 without otherwise being substantially affected by the valve operation.

In this embodiment, as valve conduits 240A, 240B and 240C extend downstream from upstream face 222 towards respective thrust structures, they each also extend somewhat outwards towards the periphery of fluid manifold 220 and away from the central axis of fluid manifold 220. In addition, as flow conduits 229A, 229B and 229C extend downstream from upstream face 222, they converge. In particular, flow conduits 229A, 229B and 229C extend somewhat inwards towards the central axis of fluid manifold 220 thereby to converge into a single, central, exit port 230. In this way, three main flows of drilling fluid formed when incoming drilling fluid reaches upstream face 222 of fluid manifold 220 re-unite downstream of the upstream face 222 before passage into drill bit 300.

Returning now to FIG. 9, valve conduit 240A conveys pressurized drilling fluid towards a respective thrust structure while valve port 226A is not blocked by plate 157. Valve conduit 240A extends past the downstream face of fluid manifold 220 a short distance to be inserted into a corresponding input conduit 242A of the respective thrust structure thereby to provide coupling between the conduits 240A, 242A. A flow restriction stage 208 just downstream of fluid manifold 220 creates backpressure centrally that is useful for causing drilling fluid at sufficient hydraulic pressure to be conveyed along valve conduit 240A.

While embodiments of thrust structures are described herein having, respectively, two cylinders and pistons each, practical embodiments of thrust structures may have three or more cylinders/pistons per thrust structure. It will be noted that, while two cylinder/pistons have been shown in the present embodiments for ease of understanding, thrust structures with fewer or somewhat more cylinder/pistons can work generally in the same manner as described herein.

In this embodiment, the thrust structure corresponding to valve conduit 240A includes input conduit 242A and two cylinders 250AA and 250AB in fluid communication with valve conduit 240A via input conduit 242A. The thrust structure also includes pistons 255AA and 255AB slidable within respective ones of the two cylinders 250AA and 250AB. In turn, pistons 255AA and 255AB interface with the underside of a single thrust paddle 260A. Thrust paddle 260A is hinged to the exterior of housing 202 of biasing subsystem 200 at its periphery and can be pivoted outwards with respect to the rotational axis upon outwards movement of the or each piston 255AA and 255AB under hydraulic pressure. Thus, thrust paddle 260A extends from the periphery of housing 202 under this condition.

When drilling fluid is permitted by plate 157 to enter into valve port 226A, input conduit 242A conveys the pressurized drilling fluid into cylinders 250AA and 250AB. An output conduit 252A extends downstream of the thrust structure and incorporates a flow-restrictor. The flow-restrictor, in this embodiment made of carbide, constricts the output conduit 252A to a smaller diameter than that of input conduit 242A thereby to cause output conduit 252A to have an effective opening that is approximately 60% of the area of the opening of input conduit 242A. This constriction increases backpressure, thereby to encourage drilling fluid to push into thrust structure rather than simply bypassing it. Drilling fluid entering into cylinders 250AA and 250AB causes, in turn, pistons 255AA and 255AB to slide outwards (upwards, as seen in FIG. 9) thereby together pushing thrust paddle 260A outwards and against the wall of the hole. Thrust paddle 260A thus contacts the wall of the hole thereby urging BHA 50 in the opposite direction. When valve port 226A is thereafter blocked, the fluid pressure in the corresponding cylinders 250AA, 250AB drops and thrust paddle 260A moves back to its rest position against housing 202. This is simply because the force against the outer side of thrust paddle 260A that is imparted by the wall is not, at this point, countered by sufficient force against the underside of thrust paddle 260A via pistons 255AA, 255AB. The drilling fluid flows further downstream from the thrust structure through output conduit 252A and its flow-restrictor. The drilling fluid flowing downstream from thrust structure the output conduit 252A then converges with the main flow of pressurized fluid about to exit the downstream end of biasing subsystem 200.

A second threaded section 206 at the downstream end of bias subsystem 200 can be threaded to a corresponding threaded section of drill bit 300 thereby to convey the pressurized fluid exiting biasing subsystem 200 into drill bit 300.

Figure 10A:
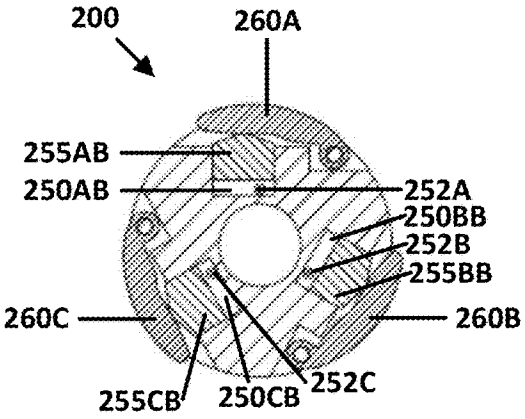
FIG. 10A is a sectional view of the bias subsystem of FIG. 8, taken along line D-D in FIG. 9.

FIG. 10A is a sectional view of bias subsystem 200, taken along line D-D in FIG. 9. In FIG. 9, only one output conduit 252A (with incorporated flow-restrictor) and corresponding thrust structure are shown. However, the sectional end view of FIG. 10A shows the relationships between the other two (2) thrust structures along with the respective output conduits 252B and 252C and their respective incorporated flow-restrictors.

In particular, in FIG. 10A there is shown a portion of a thrust structure including output conduit 252B (with respective flow-restrictor), cylinder 250BB and piston 255BB, structurally the same as cylinder 250AB and piston 255AB, driving thrust paddle 260B. Similarly, another thrust structure includes output conduit 252C (with respective flow-restrictor), cylinder 250CB and piston 255CB—structurally the same as cylinder 250AB and piston 255AB—driving thrust paddle 260C. It will be understood that, although not shown in the Figures, cylinders and pistons structurally the same as cylinder 250AA and piston 255AA of the thrust structure including input conduit 242A will also be part of the thrust structures that respectfully include input conduits 242B and 242C.

It will be appreciated that because actuator subsystem 150 exercises control over the rotational position of the single centrally-positioned plate 157 (and, in particular notch 159) with respect to fluid manifold 220, actuator subsystem exercises control over which one of thrust paddles 260A, 260B and 260C (or none of them) is pushed outwards under the influence of pressurized drilling fluid.

In this embodiment, the inward-facing side of each thrust paddle that interfaces with respective outward-facing ends of pistons is shaped to generally symmetrically distribute the force it imparts on the pistons across the pistons' stroke axis, through the extent of the piston stroke. As will be appreciated, because each thrust paddle pivots about a hinge axis that is generally parallel to the rotational axis of bias subsystem 200, and each piston slides inwardly and outwardly along its stroke axis as it interfaces with the underside of a respective thrust paddle, there is the potential for the thrust paddle to impart more force over time to the pistons in one off-axis direction than in the opposite off-axis direction. To compensate for this, the inward-facing side of each thrust paddle is angled in a way such that as the thrust paddles move in an out, the vector sum of the force imparted between the thrust paddles and the pistons over the range of their stroke is normal to the cylindrical axis of the pistons. Alternatively, the inward facing side of each thrust paddle is not planar but is instead curved in a concave way so that, as the respective pistons move both outwardly and inwardly, the inward-facing side of the thrust paddle in contact with the outward-facing ends of the pistons "rolls" about the outward-facing ends of the pistons thereby to somewhat "teeter-totter" through the full stroke with respect to the pistons' stroke axes. Generally, this "teeter-tottering" imparts force more symmetrically across the pistons' stroke axes thereby leading to less uneven wear than might an inward-facing side of a thrust paddle that was planar. Furthermore, the inward-facing side of each thrust paddle at the point it interfaces with corresponding pistons while BHA 50 is centred within the hole, extends perpendicular to the piston stroke axis. This accordingly imparts force received against each thrust paddle by the wall of the hole along the piston stroke axis when BHA 50 is centred.

Figure 10B:
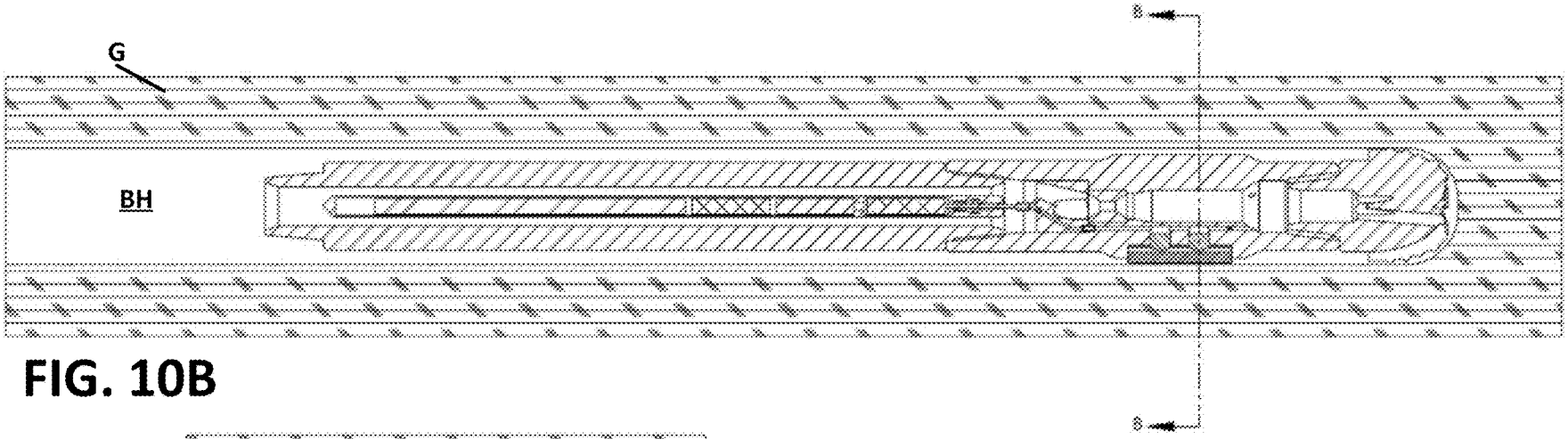
FIG. 10B is a sectional view of the bottom hole assembly similar to that shown in FIG. 2, but centred within a bore hole in the ground.
Figure 10C:
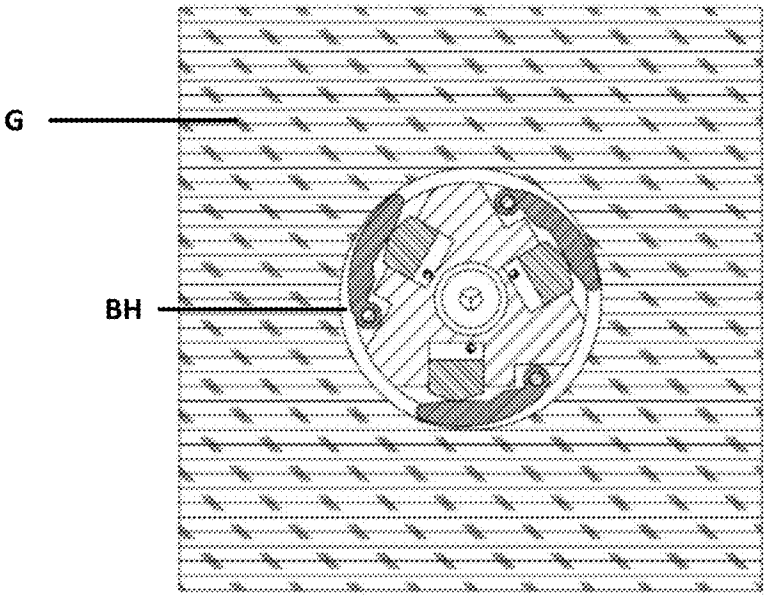
FIG. 10C is a section view of the bias subsystem of bottom hole assembly centred in the bore hole as in FIG. 10B, taken along line B-B in FIG. 10B.

FIG. 10B is a sectional view similar to that shown in FIG. 2 of bottom hole assembly 50, but with bottom hole assembly centred within a bore hole BH in the ground G. FIG. 10C is a section view of bias subsystem 200, similar to FIG. 10A but showing bottom hole assembly 200 centred in bore hole BH as in FIG. 10B, taken along line B-B in FIG. 10B. In FIG. 10C it can be seen that the underside of all of the thrust paddles are normal to their respective piston axes when the bottom hole assembly 50, and in particular bias subsystem 200, is centred in bore hole BH.

Figure 11:
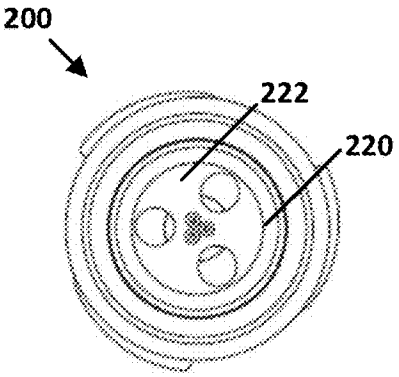
FIG. 11 is an upstream end view of the bias subsystem of FIG. 8.

An upstream end view of bias subsystem 200 is shown in FIG. 11.

Figure 15:
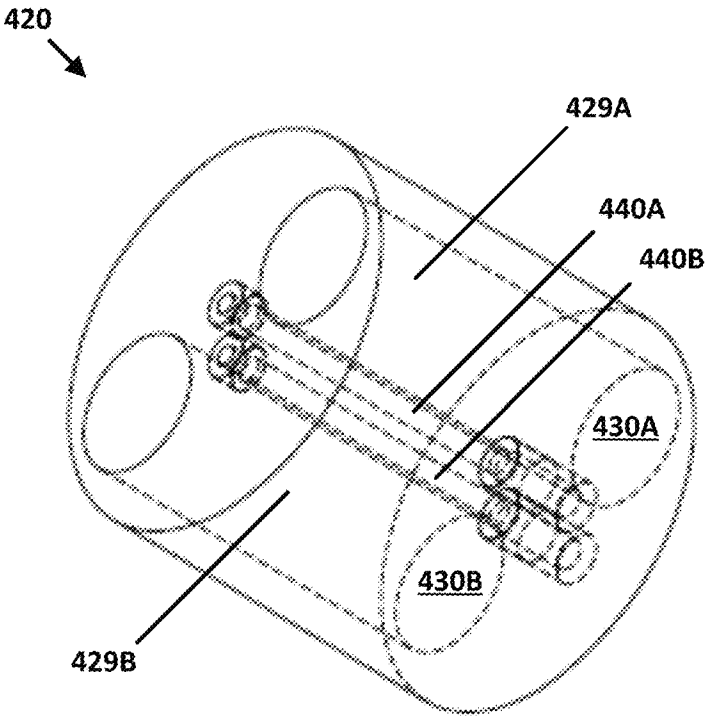
FIG. 15 is an isometric view of the fluid manifold of FIG. 14, with internal fluid conduits shown in dashed lines.
Figure 14:
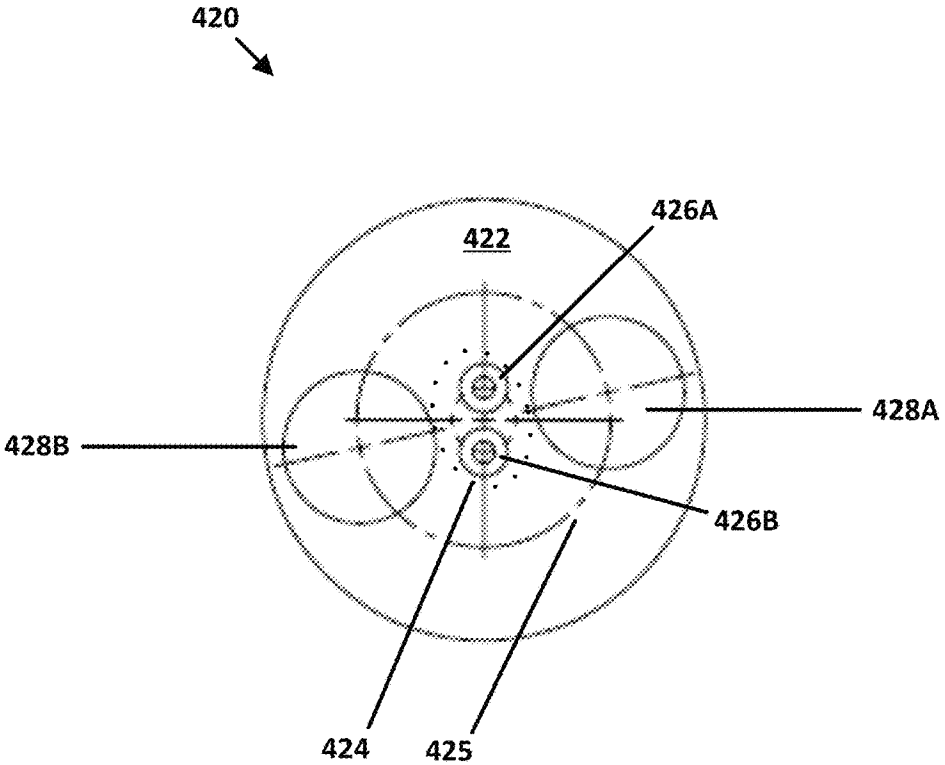
FIG. 14 is an upstream end view of a fluid manifold for a bias subsystem, according to an alternative embodiment.

FIG. 14 is an upstream end view of a fluid manifold 420 for a bias subsystem 400, according to an alternative embodiment, and FIG. 15 is an isometric view of fluid manifold 420, with internal fluid conduits shown in dashed lines. Fluid manifold 420 has an upstream face 422 that faces a flow of drilling fluid exiting from drill collar 100.

Upstream face 422 has a central region 424 (shown in dotted lines in FIG. 14) and a peripheral region 425 extending from the central region to the periphery of upstream face 422. In this embodiment, within central region 424 are two (2) valve ports 426A and 426B. Valve ports 426A and 426B are flush with and open to upstream face 422. Each of valve ports 426A and 426B is in fluid communication with a respective valve conduit 440A, 440B extending downstream from upstream face 422 of fluid manifold 420. As will be described below, when drill collar 100 is threaded to bias subsystem 400, plate 157 extending from actuator subsystem 150 extends towards upstream face 422. Plate 157 is therefore aligned centrally with respect to central region 424 of upstream face 422. Plate 157 is thus associated with valve ports 426A and 426B when biasing subsystem 400 is connected to drill collar 100. Cylindrical pin 158 extending from the downstream face of plate 157 contacts a portion of central region 424 between valve portions 426A and 426B. In embodiments, a short cylindrical cup (not shown) having walls that are parallel to the rotational axis of BHA 50 extends just slightly downstream from upstream face 422. This is provided for receiving the short cylindrical pin 158 thereby to help maintain plate 157 in a central position facing central region 424. In such embodiments, the short cylindrical cup should be sized to interfere very little with the rotation of short cylindrical pin 158.

By controlling the rotational position of plate 157 with respect to central region 424, plate 157 blocks or unblocks valve ports 426A and 426B. This enables actuator subsystem 150 to control whether pressurized drilling fluid being pumped through the drill string and into bias subsystem 400 can enter into any of valve ports 426A or 426B.

Within peripheral region 425 of upstream face 422 are two (2) flow ports 428A and 428B that are flush with, and open to, upstream face 422. In this embodiment, each of flow ports 428A and 428B is in fluid communication with a respective flow conduit 429A and 429B. Flow conduits 429A and 429B extend downstream from upstream face 422 of fluid manifold 420. Plate 157 is sized only to interface with central region 424 of upstream face 422 and not substantially with peripheral region 425 of upstream face 422. As such, flow ports 428A and 428B remain substantially unblocked by any valves. In this way, a main flow of drilling fluid can proceed downstream to be conveyed towards drill bit 300 without otherwise being substantially affected by the valve operation.

In this embodiment, as valve conduits 440A and 440B extend downstream from upstream face 422 towards respective thrust structures, they each continue generally linearly in alignment with the central axis of fluid manifold 420. In addition, as flow conduits 429A and 429B extend downstream from upstream face 422 they also each continue generally linearly in alignment with the central axis of fluid manifold 420. In this way, two main flows of drilling fluid formed when incoming drilling fluid reaching upstream face 422 of fluid manifold 420 continue through fluid manifold 420 out of respective exit ports 430A, 430B for passage into the drill bit 300. A second threaded section 406 at the downstream end of bias subsystem 400 can be threaded to a corresponding threaded section of drill bit 300 thereby to convey the pressurized fluid exiting biasing subsystem 400 into drill bit 300. It can be seen that flow conduits 429A and 429B extend within housing in alignment with the rotational axis of the bias system, but more peripherally than do the smaller valve conduits 440A, 440B, which extend within housing closer to and in alignment with the rotational axis of bias subsystem 400. In this manner, particularly in the region of the thrust structures, the cylinder depths and piston lengths are able to extend closer to the rotational axis. This is as compared to how close the cylinder depths and piston lengths would be able to extend were the larger flow conduits 429A, 429B (or a single large flow conduit) to run through the centre of housing 402 and thus between the thrust structures and the rotational axis.

Figure 16:
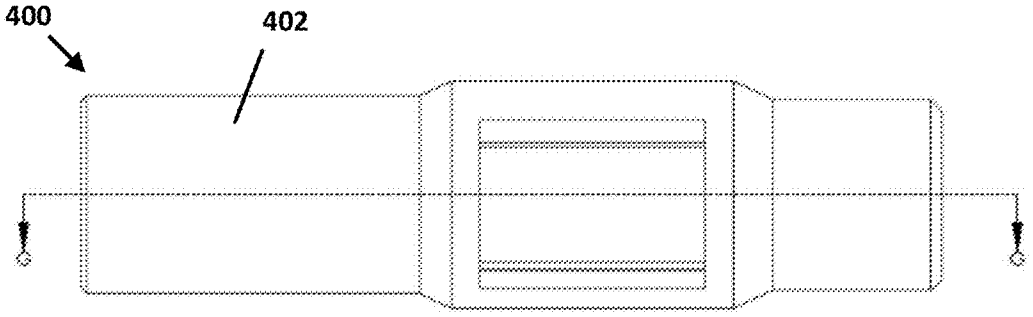
FIG. 16 is an elevation view of the bias subsystem that incorporates the fluid manifold of FIG. 14.
Figure 17:
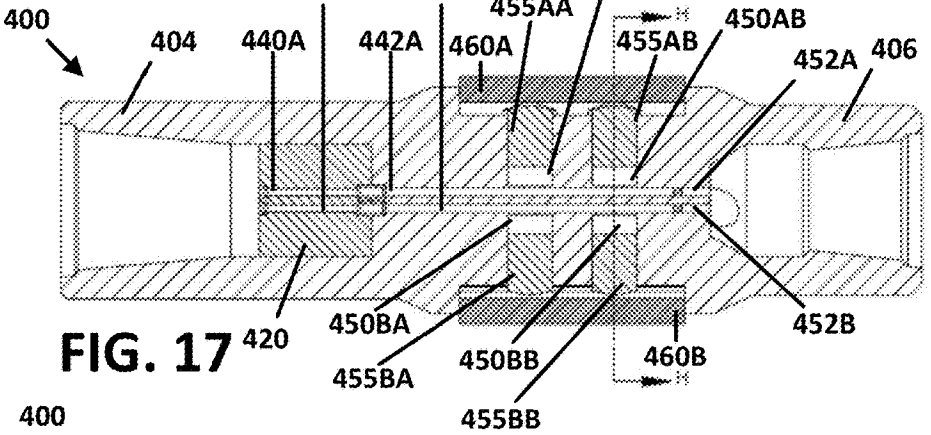
FIG. 17 is a sectional view of the bias subsystem of FIG. 16, taken along line G-G in FIG. 16.

FIG. 16 is an elevation view of bias subsystem 400 having a housing 402 incorporating fluid manifold 420, and FIG. 17 is a sectional view of bias subsystem 400, taken along line G-G in FIG. 16. Bias subsystem 400, similar to bias subsystem 200, includes a first threaded section 404 at an upstream end and a second threaded section 406 at a downstream end.

Valve conduit 440A, while valve port 426A is not blocked by plate 157, conveys pressurized drilling fluid towards a respective thrust structure. Valve conduit 440A extends past the downstream face of fluid manifold 420 a short distance to be inserted into a corresponding input conduit 442A of the respective thrust structure thereby to provide coupling between the conduits 440A, 442A. In this embodiment, the thrust structure corresponding to valve conduit 440A includes input conduit 442A and two cylinders 450AA and 450AB in fluid communication with valve conduit 440A via input conduit 442A. The thrust structure also includes pistons 455AA and 455AB slidable within respective ones of the two cylinders 450AA and 450AB. In turn, pistons 455AA and 455AB interface with the underside of a single thrust paddle 460A. Thrust paddle 460A is hinged to the exterior of housing 402 of biasing subsystem 400 at its periphery and can be pivoted outwards with respect to the rotational axis upon outwards movement of the or each piston 455AA and 455AB under hydraulic pressure. Thus, thrust paddle 460A extends from the periphery of housing 402 under this condition.

When drilling fluid is permitted by plate 157 to enter into valve port 426A, input conduit 442A conveys the pressurized drilling fluid into cylinders 450AA and 450AB. Aided by backpressure from the flow-restrictor in output conduit 252A this, in turn, causes pistons 455AA and 455AB to be thrust outwards (upwards, as seen in FIG. 17) thereby together pushing thrust paddle 460A outwards and against the wall of the hole. Thrust paddle 460A contacting the wall of the hole thereby urges BHA 50 in the opposite direction. When valve port 426A is thereafter blocked, the fluid pressure in the corresponding cylinders 450AA, 450AB drops and thrust paddle 460A moves back to its rest position against housing 402. This is simply because the force against the outer side of thrust paddle 460A that is imparted by the wall is not, at this point, countered by sufficient force against the underside of thrust paddle 460A via pistons 455AA, 455AB. The drilling fluid flows further downstream from the thrust structure through output conduit 452A to then meet and join the main flow of pressurized fluid about to exit biasing subsystem 400.

Similarly, valve conduit 440B, while valve port 426B is not blocked by plate 157, conveys pressurized drilling fluid towards a respective thrust structure. In this embodiment, the thrust structure corresponding to valve conduit 440B includes input conduit 442B and two cylinders 450BA and 450BB in fluid communication with valve conduit 440B via an input conduit 442B. This thrust structure includes pistons 455BA and 455BB slidable within respective ones of the two cylinders 450BA and 450BB. In turn, pistons 455BA and 455BB interface with the underside of a single thrust paddle 460B. Thrust paddle 460B is also hinged to the exterior of housing 402 of biasing subsystem 400 and can be pivoted outwards with respect to the rotational axis upon outwards movement of the or each piston 455BA and 455BB under hydraulic pressure. Thus, thrust paddle 460B extends from the periphery of housing 402 under this condition.

When drilling fluid is permitted by plate 157 to enter into valve port 426B, input conduit 442B conveys the pressurized drilling fluid into cylinders 450BA and 450BB. This, in turn, causes pistons 455BA and 455BB to be thrust outwards (downwards, as seen in FIG. 17) thereby together pushing thrust paddle 460B outwards and against the wall of the hole. Thrust paddle 460B contacting the wall of the hole thereby urges BHA 50 in the opposite direction. When valve port 426B is thereafter blocked, the fluid pressure in the corresponding cylinders 450BA, 450BB drops, and thrust paddle 460B moves back to its rest position against housing 402. This is simply because the force against the outer side of thrust paddle 460B that is imparted by the wall is not, at this point, countered by sufficient force against the underside of thrust paddle 460B via pistons 455BA, 455BB. The drilling fluid flows further downstream from the thrust structure to then meet and join the main flow of pressurized fluid about to exit biasing subsystem 400.

In this embodiment, the inward-facing side of each thrust paddle that interfaces with respective outward-facing ends of pistons is shaped to generally symmetrically distribute the force it imparts on the pistons across the pistons' stroke axis, through the extent of the piston stroke. As will be appreciated, because each thrust paddle pivots about a hinge axis that is generally parallel to the rotational axis of bias subsystem 400, and each piston slides inwardly and outwardly along its stroke axis as it interfaces with the underside of a respective thrust paddle, there is the potential for the thrust paddle to impart more force over time to the pistons in one off-axis direction than in the opposite off-axis direction. To compensate for this, the inward-facing side of each thrust paddle is angled in a way such that as the thrust paddles move in an out, the vector sum of the force imparted between the thrust paddles and the pistons over the range of their stroke is normal to the cylindrical axis of the pistons. Alternatively, the inward-facing side of each thrust paddle is not planar but is instead curved in a convex way so that, as the respective pistons move both outwardly and inwardly, the inward-facing side of the thrust paddle in contact with the outward-facing ends of the pistons "rolls" about the outward-facing ends of the pistons thereby to somewhat "teeter-totter" through the full stroke with respect to the pistons' stroke axes. Generally, this "teeter-tottering" imparts force more symmetrically across the pistons' stroke axes thereby leading to less uneven wear than might an inward-facing side of a thrust paddle that was planar. Furthermore, the inward-facing side of each thrust paddle at the point it interfaces with corresponding pistons while BHA 50 is centred within the hole, extends perpendicular to the piston stroke axis. This accordingly imparts force received against each thrust paddle by the wall of the hole along the piston stroke axis when BHA 50 is centred.

Figure 19:
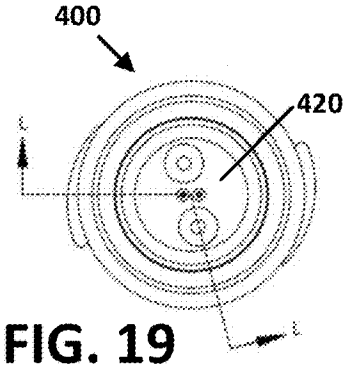
FIG. 19 is an upstream end view of the bias subsystem of FIG. 16.
Figure 18:
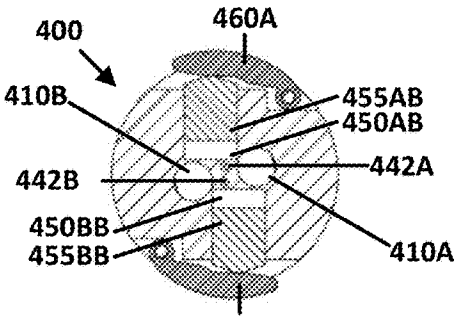
FIG. 18 is a sectional view of the bias subsystem of FIG. 16, taken along line H-H in FIG. 17.

FIG. 18 is a sectional view of the bias subsystem 400, taken along line H-H in FIG. 17. FIG. 19 is an upstream end view of the bias subsystem of FIG. 16.

Figure 20:
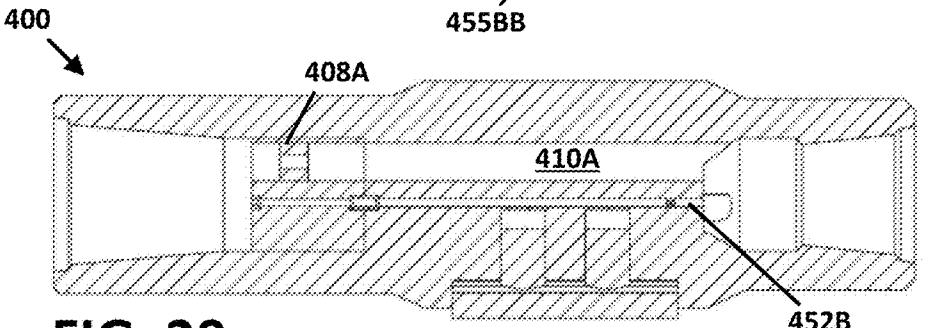
FIG. 20 is a section view of the bias subsystem of FIG. 16, taken along line L-L in FIG. 19.

FIG. 20 is a section view of the bias subsystem of FIG. 16, taken along line L-L in FIG. 19. A flow restriction stage 408A within flow conduit 410A of fluid manifold 420 creates backpressure for causing drilling fluid at sufficient hydraulic pressure to do work to be conveyed along valve conduit 240A. Similar, although not shown in the figures, a flow restriction stage within flow conduit 410B of fluid manifold 420 similarly contributes to the backpressure.

With fluid manifold 420, the valve conduits 440A and 440B extend generally centrally within bias subsystem 400 and the flow conduits 410A and 410B extend generally peripherally. This configuration leaves room for valve conduits 440A and 440B to be closer to the axis of bias subsystem 400 than, for example, the valve conduits for the bias subsystem 200. Either configuration of bias subsystem 200 or 400 can interface effectively with a centrally positioned, single-plate actuator subsystem such as actuator subsystem 150 due to their similarly centrally positioned valve ports. This provides the useful ability to control multiple thrust structures using a single plate. However, additionally, because valve conduits 440A and 440B of bias subsystem 400 are centrally positioned and the flow conduits 410A and 410B are somewhat peripherally positioned, valve conduits 440A and 440B can interface with downstream thrust structures having deeper cylinders 450AA, 450AB, 450BA and 450BB. Because cylinders 450AA, 450AB, 450BA and 450BB can be deeper, the cross-sectional area of the corresponding pistons 455AA, 455AB, 455BA and 455BB can be made wider without correspondingly causing cocking or jamming of pistons 455AA, 455AB, 455BA and 455BB within cylinders 450AA, 450AB, 450BA and 450BB, because of the increased engagement. Since thrust force imparted on thrust paddles 460A and 460B is linearly correlated with piston cross-sectional area, the bias assembly 400 can impart more thrust against the walls of the hole, all other factors being equal.

Bias subsystem 400 is an example of a configuration in which the innermost components of thrust structures (i.e., the inlet conduits and corresponding bottoms of cylinders) extend inwards very closely to the rotational axis of bias subsystem 400. These components are able to extend inwards very closely to the rotational axis of bias subsystem 400 because the flow conduits, which must be large enough to permit sufficient drilling fluid flow through bias subsystem 400, are positioned within bias subsystem 400 so as to not lie between (are not "intermediate") these innermost components of thrust structures and the rotational axis of bias subsystem 400. As seen in FIG. 18, flow conduits 410A and 410B "straddle" the rotational axis of bias subsystem 400 (into the page in FIG. 18) in a different direction than that in which the thrust structure components "straddle" the rotational axis. For example, roughly-speaking, as oriented in FIG. 18, the thrust structures including cylinders 450AB and 450BB straddle the rotational axis in the "North-South" direction, whereas the flow conduits 410A, 410B straddle the rotational axis in the "East-West" direction and are additionally radially spaced a sufficient distance from the rotational axis to allow the innermost portions of the cylinders to approach the rotational axis. Permitting the innermost components of thrust structures to extend near to the rotational axis of the bias subsystem permits a longer stroke for the pistons 455AB, 455BB within respective cylinders 450AB, 450BB. As described herein, a long piston stroke in turn permits the piston diameter, and accordingly the thrust force, to be larger than when compared to systems permitting a shorter piston stroke length, due to the reduced risk of cocking/jamming It will be appreciated that other configurations involving positioning flow conduits within bias subsystem so as to not generally be between the innermost of the thrust structure components and the rotational axis, using similar principles of spacing and straddling, are contemplated.

Figure 21:
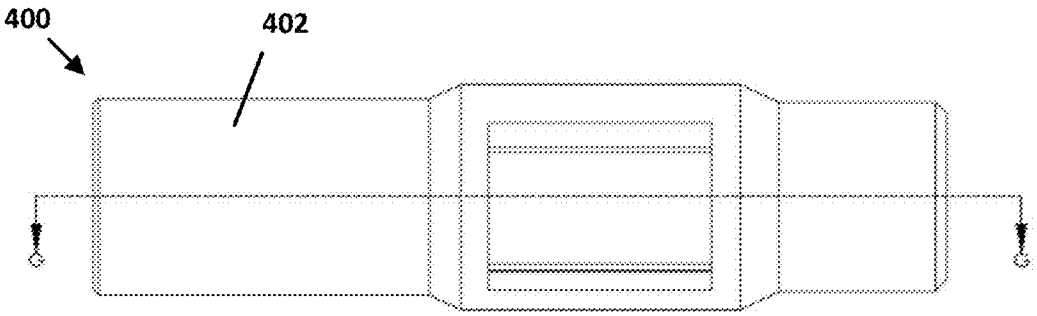
FIG. 21 is another elevation view of the bias subsystem that incorporates the fluid manifold of FIG. 14, with one of the thrust structures somewhat extended for steering, according to an embodiment.
Figure 22:
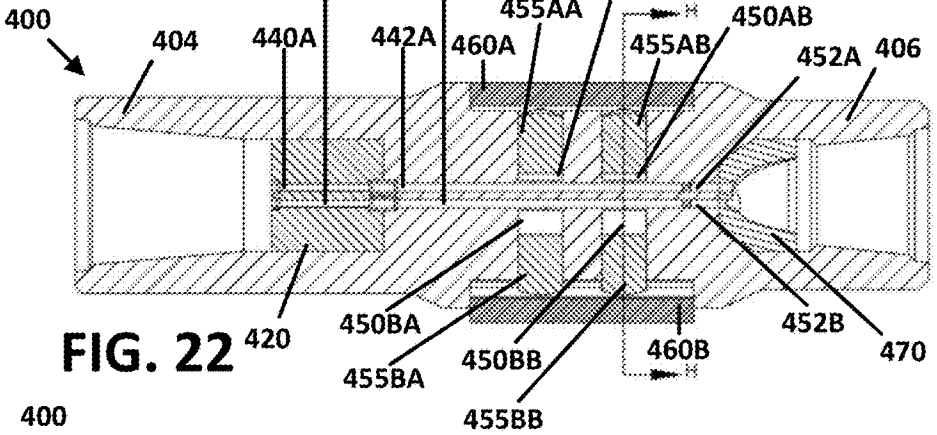
FIG. 22 is a sectional view of the bias subsystem of FIG. 21, taken along line G-G in FIG. 21 and showing the bias subsystem also incorporating a flow-converger downstream of the thrust structures.

FIG. 21 is another elevation view of bias subsystem 400, with one of the thrust structures somewhat extended for steering, according to an embodiment. FIG. 22 is a sectional view of bias subsystem 400, taken along line G-G in FIG. 21. In FIG. 22, a flow-converger 470 is incorporated within housing 402 downstream of the thrust structures for converging the drilling fluid being conveyed downstream of the thrust structures and out through output conduits 452A, 452B with the drilling fluid being conveyed through flow conduits 410A, 410B before the converged drilling fluid enters into drill bit 300.

Figure 25:
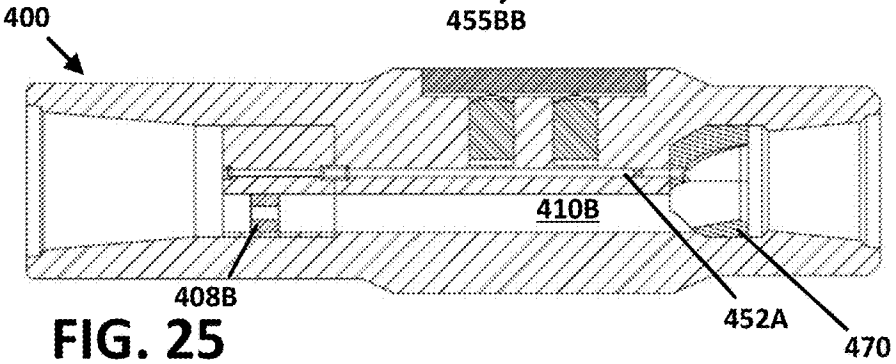
FIG. 25 is a section view of the bias subsystem of FIG. 21, taken along line R-R in FIG. 24.
Figure 24:
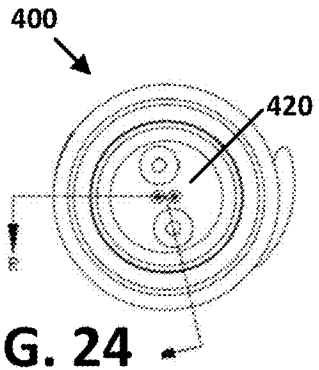
FIG. 24 is an upstream end view of the bias subsystem of FIG. 21.
Figure 23:
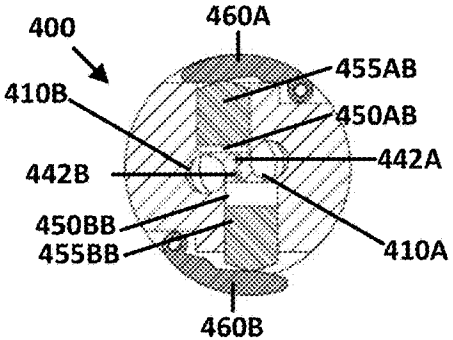
FIG. 23 is a sectional view of the bias subsystem of FIG. 21, taken along line H-H in FIG. 22.

FIG. 23 is a sectional view of bias subsystem 400 incorporating flow-converger 470, taken along line H-H in FIG. 22. FIG. 24 is another upstream end view of bias subsystem 400, and FIG. 25 is a section view of bias subsystem 400 incorporating flow-converger 470, taken along line R-R in FIG. 24.

Flow-converger 470 functions to re-integrate the multiple streams of drilling fluid that are formed upstream of the thrust structures by fluid manifold 420, at a point downstream of the thrust structures. Flow-converger 470 thereby provide a single merged and integrated stream of drilling fluid to drill bit 300 rather than multiple separate streams. In this way, the velocity and pressure of drilling fluid being presented to drill bit 300 by biasing subsystem 400 incorporating flow-converger 470 can generally be uniform.

Figure 27:
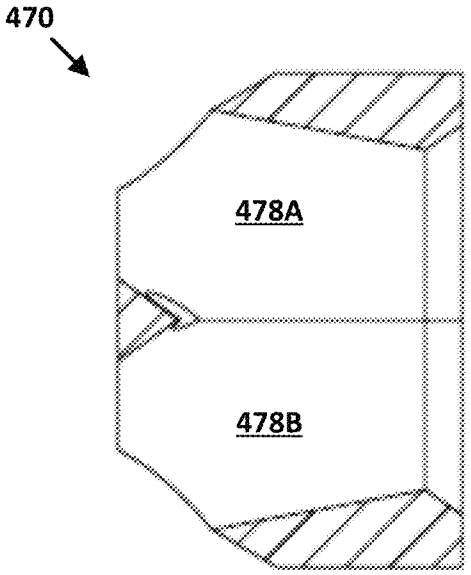
FIG. 27 is a sectional view of the flow-converger of FIG. 22, taken along line P-P in FIG. 26.
Figure 26:
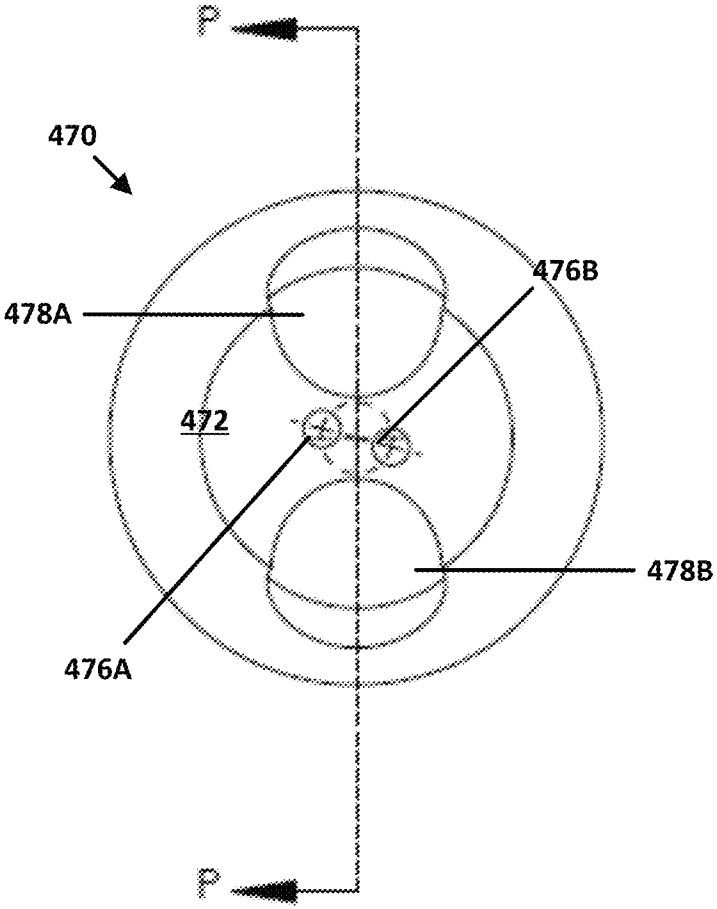
FIG. 26 is an upstream end view of the flow-converger of FIG. 22, in isolation, according to an embodiment.

FIG. 26 is an upstream end view of flow-converger 470, and FIG. 27 is a sectional view of flow-converger 470, taken along line P-P in FIG. 26.

Flow-converger 470 is positioned downstream of the thrust structures and has an upstream face 472 that faces a flow of drilling fluid being conveyed along flow conduits 410A, 410B and output conduits 452A, 452B. Upstream face 472 has a central region with a planar face incorporating two (2) smaller converger conduits 476A, 476B aligned with and output conduits 452A, 452B. A peripheral region of upstream face 472 is bevelled downstream from the planar face of the central region. Two larger converger conduits 478A, 478B are formed through the central and peripheral regions. The smaller converger conduits 476A, 476B are short and terminate at the upstream end of a chamber 480. The larger converger conduits 478A, 478B are angled towards chamber 480 so as to receive drilling fluid near to the periphery of upstream face 472 and convey it inwards towards the rotational axis of bias subsystem 400. The flows of drilling fluid entering chamber 480 via conduits 476A, 476B, 478A, and 478B re-converge and mix to quell eddy currents and turbulence thereby to produce a generally-uniform single output flow of drilling fluid within chamber 480 that then can exit chamber 480 via flow-converger opening 482 for entry into drill bit 300.

Figure 29:
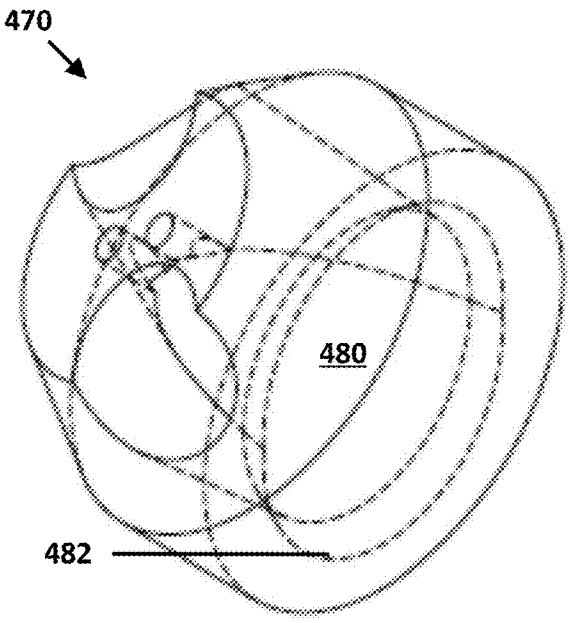
FIG. 29 is an upstream isometric view of the flow-converger of FIG. 22, with internal fluid conduits shown in dashed lines.
Figure 28:
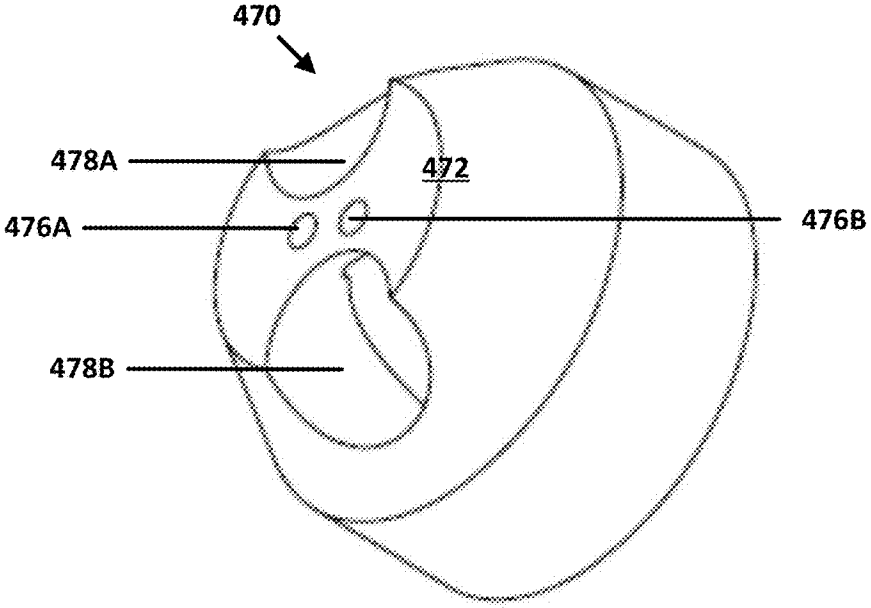
FIG. 28 is an upstream isometric view of the flow-converger of FIG. 22.

FIG. 28 is an upstream isometric view of flow-converger 470, and FIG. 29 is an upstream isometric view of flow-converger 470, with internal fluid conduits shown in dashed lines.

Figure 30:
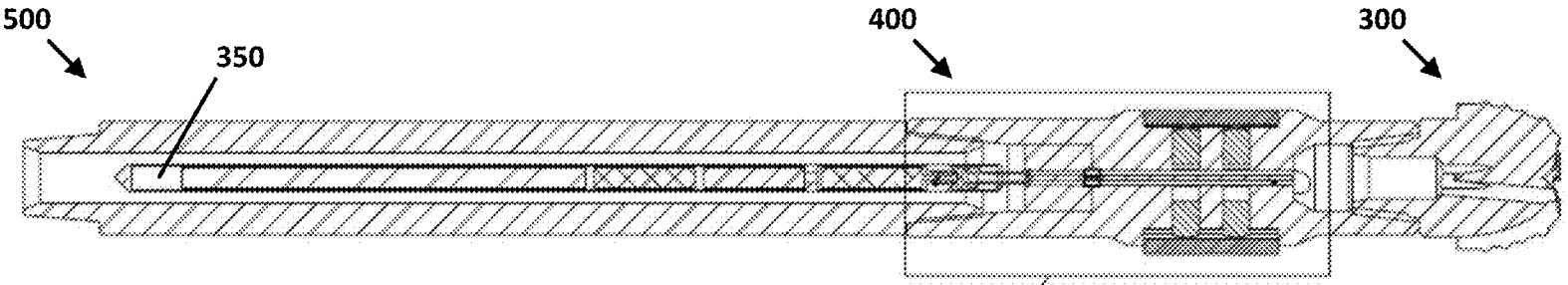
FIG. 30 is a sectional view of a bottom hole assembly, showing an actuator subsystem according to an alternative embodiment housed within the drill collar.

FIG. 30 is a sectional view of a bottom hole assembly, showing an actuator subsystem 350 for an alternative bottom hole assembly (BHA) 500, according to an alternative embodiment housed within drill collar 100. BHA 500, in this embodiment, is connectable to the bottom of a drill string in the same manner as is BHA 50.

Figure 31:
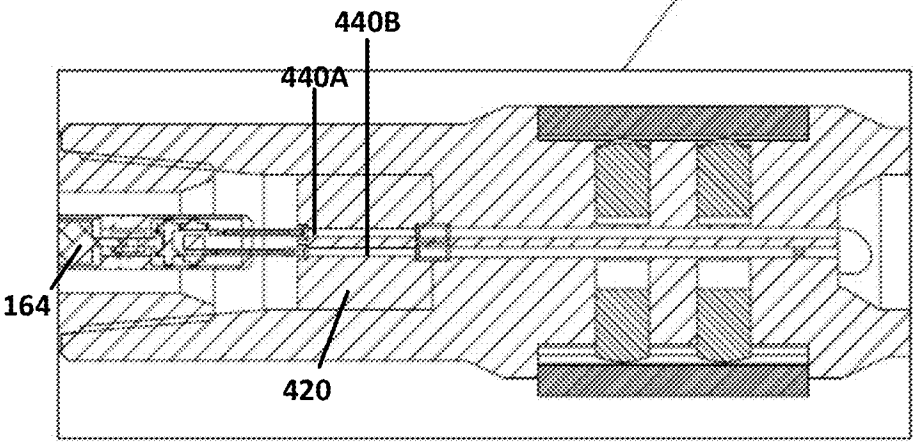
FIG. 31 is a magnified view of a downstream portion of the actuator subsystem shown in FIG. 30.
Figure 32:
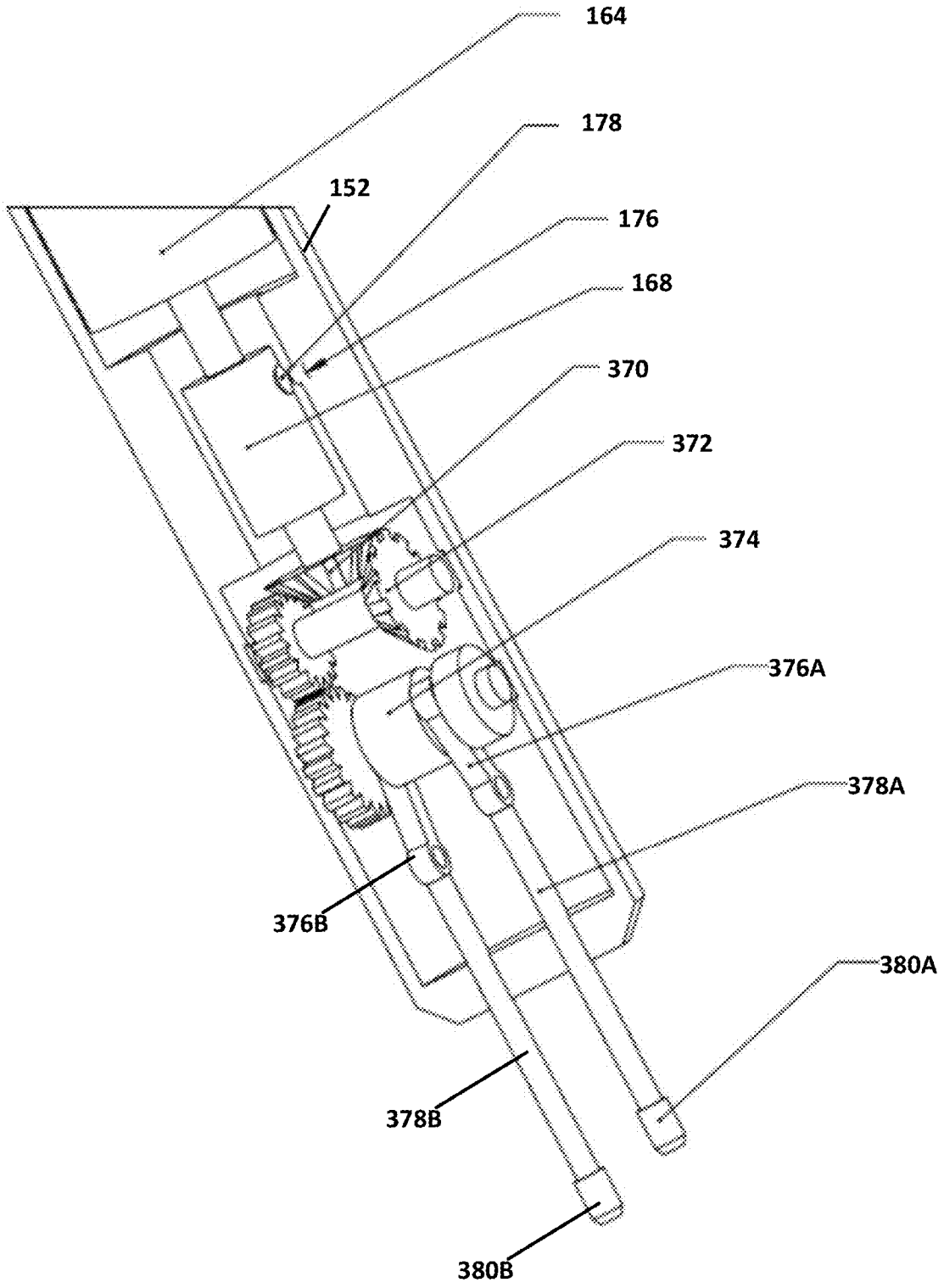
FIG. 32 is a magnified isometric view of parts of a downstream portion of the actuator subsystem shown in FIG. 30.

FIG. 31 is a magnified view of a downstream portion of actuator subsystem 350, and FIG. 32 is a magnified isometric view of parts of a downstream portion of actuator subsystem 350. Like actuator subsystem 150, actuator subsystem 350 is housed within a tube 152, and includes an actuator 164 that is, in this embodiment, an electric motor/gearbox package 164. In this embodiment, the output shaft of electric motor/gearbox package 164 is axially coupled, via coupler 168, with a shaft of a bevel gear 370. Bevel gear 370 rotates when driven via the coupling by motor/gearbox 164 about a rotational axis corresponding to the rotational axis of BHA 500. Bevel gear 370, in turn, interfaces with bevel gear 372. Bevel gear 372 is rotatable along with a shaft that extends normal to the rotational axis of BHA 500. At the opposite end of this shaft is a standard gear whose teeth mesh with a corresponding gear of a crankshaft assembly 374. Crankshaft assembly 374 rotates about an axis normal to the rotational axis of BHA 500 in response to power transmitted from motor/gearbox 164 through coupler 168 and bevel gears 370, 372. As crankshaft assembly 374 so rotates, connecting rods 376A, 376B of crankshaft assembly 374 move respective poppet shafts 378A, 378B up and down in upstream-downstream direction. This, in turn, moves respective poppets 380A, 380B into and out of engagement with respective valve ports 426A, 426B of fluid manifold 420. In this way, actuator assembly 350 can block or unblock valve ports 426A, 426B in order to control whether pressurized drilling fluid can be conveyed to respective thrust structures. In this embodiment, valve ports 426A, 426B may have slightly beveled openings for receiving the slightly beveled ends of poppets 380A, 380B thereby to provide some guidance for centring poppets 380A, 380B within valve ports 426A, 426B thereby to effectively plug them when in contact.

It will be understood that, due to the structure of crankshaft assembly 374, unlike actuator assembly 150, actuator assembly 350 cannot be controlled to block both of valve ports 426A, 426B simultaneously. As such, with actuator assembly 350, a coast mode may be achieved by continuing to actuate all of the thrust structures in a quasi-random or some other self-opposing way while the drill string is turning.

While the valve structure using poppets 380A, 380B is more complex than a valve structure using plate 157, it may carry certain benefits. For example, due to their being received within valve ports 426A, 426B to a degree, poppets 380A, 380B can provide more certain port blockage than can plate 157. Furthermore, the poppet structure may be able to better withstand interference from certain lost circulation material (LCM), such as sawdust, which might be pumped downhole along with the drilling fluid, than the plate structure described above. Still further, the poppet structure may be less susceptible to jams due to solids that might accumulate under a plate such as plate 157.

Although embodiments have been described with reference to the drawings, those of skill in the art will appreciate that variations and modifications may be made without departing from the spirit, scope and purpose of the invention as defined by the appended claims.

For example, while in embodiments described herein the actuator subsystem is incorporated within a drill collar that is just upstream of the bias subsystem, alternatives are possible. For example, the actuator subsystem may alternatively be incorporated within another kind of drill string component just upstream of the bias subsystem, such as drill pipe, an MWD component, or a Logging While Drilling (LWD) component.

Furthermore, while in embodiments described herein the thrust structures each include two cylinders with corresponding pistons, alternatives are contemplated in which the thrust structures each have only one cylinder with corresponding piston or more than two cylinders with corresponding pistons. Alternatives are also contemplated in which there are more than three thrust structures in a bias subsystem. It will be understood that, in order to accommodate larger numbers of thrust structures, the number of valve ports extending from a fluid manifold will correspondingly be greater. This will accordingly require dimensional adjustments in the plate, the fluid manifold, and other structures.

Furthermore, different configurations of plate for a plate valve component will be required where the valve ports are not uniformly spaced in the central region of the upstream face of the fluid manifold, or where there are additional valve ports to be blocked at any given moment.

Furthermore, while in embodiments a pin extends from a downstream face of a plate portion of a valve to interface with a corresponding cup in the upstream face of the fluid manifold, alternatives are possible. For example, embodiments in which there is no such pin/cup pair are contemplated, as well as are embodiments in which such a pin is provided with no cup counterpart, or with a cup counterpart that extends slightly from the upstream face rather than downstream from it. Variations are possible.

Furthermore, while embodiments described include a fluid manifold as a separate component within bias subsystems, alternatives are possible in which fluid flows are split as between valve ports and flow ports with a structure that is integral to the bias subsystem. For example, fluid flows may be split by structures integral with the housing of the bias subsystem, such that the upstream face described herein in connection with the manifolds or a functionally equivalent structure is itself alternatively an integral part of the housing rather than part of a separate manifold component. Furthermore, alternative structures for splitting fluid flows than the particular embodiments described herein may be contemplated for use in the manner disclosed herein.

Furthermore, while embodiments described include a flow-converger as a separate component with bias subsystems downstream of the thrust structures, a flow-converger may alternatively be a structure formed within housing itself.

Furthermore, while in embodiments described output shaft 154 of actuator subsystem 150 extends through both axial load thrust bearing stack 172 and radial bearing stack 174, alternatives are possible in which output shaft 154 is otherwise kept in line axially and/or radially either without any of stacks 172, 174, or without one or the other of them.

What is claimed is:

1. A steerable bottom hole assembly (BHA) comprising:

a drill string component incorporating an actuator subsystem, the actuator subsystem comprising an actuator having an output shaft for selectively rotating a valve plate 66 about a rotational axis of the BHA ; the actuator subsystem further comprising:

a position marker on the output shaft;

a position sensor proximate the output shaft, wherein the position sensor and the position marker interact when the position marker is rotated with the output shaft to a position adjacent the position sensor, the position sensor in response signalling the actuator subsystem for use in controlling the rotational orientation of the valve plate;

the BHA assembly further comprising a bias subsystem extending between the drill string component and a drill bit 36, the bias subsystem receiving a flow of pressurized drilling fluid via the drill string component and comprising:

a housing;

a plurality of hydraulic thrust structures associated with a periphery of the housing;

a plurality of central valve conduits in the housing to convey drilling fluid for actuating a respective one of the hydraulic thrust structures; and a plurality of peripheral flow conduits in the housing to convey drilling fluid to the drill bit, the flow conduits being closer to the periphery than the central valve conduits wherein, in accordance with a selected rotational orientation of the valve plate with respect to the valve conduits, pressurized drilling fluid is selectively permitted, or blocked from, entry into the valve conduits.

2. The steerable BHA of claim 1, wherein the bias subsystem further comprises:

a flow-converger downstream of the thrust structures, the flow-converger incorporating converger conduits for receiving and converging flows of drilling fluid from the central valve conduits and the peripheral flow conduits into a single output flow prior to entry into the drill bit.

3. The steerable BHA of claim 1, further comprising within the housing:

a fluid manifold having an upstream face with:

a peripheral region incorporating flow ports each associated with a respective one of the peripheral flow conduits; and a central region incorporating valve ports each associated with a respective one of the central valve conduits, the central region interfacing with the plate for, in accordance with a selected rotational orientation of the plate with respect to the upstream face, blocking or sequentially permitting drilling fluid to enter into the valve ports.

4. The steerable BHA of claim 3, wherein the fluid manifold is affixed within the housing.

5. The steerable BHA of claim 3, wherein the fluid manifold incorporates:

two flow ports; and two valve ports.

6. The steerable BHA of claim 5, wherein each of the two peripheral flow conduits extends downstream substantially in parallel with a rotational axis of the bias subsystem.

7. The steerable BHA of claim 1, wherein each thrust structure comprises:

an input port;

at least one cylinder in fluid communication with the input port;

a piston moveable within each of the at least one cylinder inwards and outwards with respect to a rotational axis of the bias subsystem;

a thrust paddle interfacing with the or each piston at the periphery of the housing, the thrust paddle hinged with respect to the housing and pivotable outwards with respect to the rotational axis upon outwards movement of the or each piston under hydraulic pressure thereby to extend from the housing.

8. The steerable BHA of claim 7, wherein an inward-facing side of each thrust paddle is shaped to symmetrically distribute force imparted on respective one or more pistons across the pistons' stroke axis, through the extent of piston stroke.

9. The steerable BHA of claim 8, wherein the inward-facing side of each thrust paddle is shaped to, while the BHA is centred within a hole, impart force to respective one or more pistons in alignment with a respective stroke axis of the pistons.

10. The steerable BHA of claim 1, wherein the actuator subsystem is fixed and centrally positioned within a fluid conduit of the drill string component thereby to rotate with the drill string component about a rotational axis of the drill string component.

11. The steerable BHA of claim 10, wherein the actuator subsystem comprises:

a tube dimensioned and centrally positioned within the fluid conduit thereby to leave an annular flow region for drilling fluid between the tube and an inner wall of the fluid conduit, wherein the actuator is housed within the tube; wherein the output shaft extends axially beyond a downstream end of the tube thereby to interface with a plate valve component, wherein the valve plate is a part of the plate valve component.

12. The steerable BHA of claim 11, wherein the plate valve component further comprises a sleeve for receiving the output shaft.

13. The steerable BHA of claim 12, wherein the output shaft is keyed to be affixed within a corresponding slot within the sleeve of the plate valve component thereby to be rotationally affixed to the sleeve but axially slidable with respect to the sleeve.

14. The steerable BHA of claim 1, wherein the actuator comprises an electric motor and a gearbox.

15. The steerable BHA of claim 1, further comprising an axial bearing stack within the tube for receiving the output shaft therethrough thereby to axially support the output shaft along the rotational axis of the drill string component.

16. The steerable BHA of claim 11, wherein the actuator subsystem further comprises:

a control board within the tube and in communication with the actuator thereby to control the rotational angle of the output shaft;

a portable power supply for powering at least the control board and the actuator; and a sensor package for measuring the orientation of the earth's magnetic field and a gravity vector.

17. The steerable BHA of claim 1, wherein the position sensor is a Hall sensor and the position marker is a magnet.

18. The steerable BHA of claim 1, wherein the valve plate is generally circular and incorporates a notch for allowing passage of drilling fluid downstream of the valve plate into a selected one of the central valve conduits.

19. The steerable BHA of claim 18, wherein the notch is dimensioned with respect to the plurality of central valve conduits and the valve plate to be selectively oriented to permit drilling fluid to enter into only one central valve conduit at a time.

20. The steerable BHA of claim 19, wherein the notch is dimensioned with respect to the plurality of central valve conduits and the valve plate to be selectively oriented to permit drilling fluid to enter into none of the central valve conduits.

* * * * *